US011624265B1

(12) United States Patent
Sehsah et al.

(10) Patent No.: US 11,624,265 B1
(45) Date of Patent: Apr. 11, 2023

(54) CUTTING PIPES IN WELLBORES USING DOWNHOLE AUTONOMOUS JET CUTTING TOOLS

(71) Applicant: Saudi Arabian Oil Company, Dhahran (SA)

(72) Inventors: Ossama R. Sehsah, Dhahran (SA); Amjad Shaarawi, Khobar (SA); Chinthaka Pasan Gooneratne, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/525,570

(22) Filed: Nov. 12, 2021

(51) Int. Cl.
*E21B 43/114* (2006.01)
*E21B 47/095* (2012.01)
*E21B 47/16* (2006.01)

(52) U.S. Cl.
CPC ..... *E21B 43/114* (2013.01); *E21B 47/095* (2020.05); *E21B 47/16* (2013.01)

(58) Field of Classification Search
CPC ..... E21B 43/11; E21B 43/114
See application file for complete search history.

(56) References Cited

U.S. PATENT DOCUMENTS

| | | | |
|---|---|---|---|
| 891,957 | A | 6/1908 | Schubert |
| 1,794,045 | A | 2/1931 | Warner |
| 1,812,044 | A | 6/1931 | Grant |
| 1,839,764 | A | 1/1932 | Kittredge et al. |
| 1,998,732 | A | 4/1935 | Olds |
| 2,043,225 | A | 6/1936 | Armentrout et al. |
| 2,110,913 | A | 3/1938 | Lowrey |
| 2,227,729 | A | 1/1941 | Lynes |
| 2,286,673 | A | 6/1942 | Douglas |
| 2,305,062 | A | 12/1942 | Church et al. |
| 2,344,120 | A | 3/1944 | Baker |

(Continued)

FOREIGN PATENT DOCUMENTS

| | | |
|---|---|---|
| AU | 2005286168 | 3/2006 |
| AU | 2012231398 | 10/2017 |

(Continued)

OTHER PUBLICATIONS

U.S. Appl. No. 16/524,935, filed Jul. 29, 2019, Zhan et al.

(Continued)

*Primary Examiner* — Kristyn A Hall
(74) *Attorney, Agent, or Firm* — Fish & Richardson P.C.

(57) ABSTRACT

A downhole autonomous jet cutting tool includes a main body with a generally cylindrical configuration. The main body includes a locking unit actuable to engage the tool to an inner surface of the pipe, a hydraulic motor with a rotor and a stator, and a rotatable jet cutting nozzle assembly operable to emit a stream of fluid to cut the pipe. The tool also includes a sensor module to detect interactions between the pipe and walls of the wellbore and a control unit in electronic communication with the sensor module and the locking unit. The control unit can identify, based on output of the sensor module, a location where interaction between the pipe and the walls of the wellbore limits downhole movement of the pipe, actuate the locking unit to engage the tool in the inner surface of the pipe, and initiate the stream of fluid from the nozzle assembly.

12 Claims, 15 Drawing Sheets

(56) References Cited

U.S. PATENT DOCUMENTS 2,427,361 A 9/1947 Lofgren
2,757,738 A 9/1948 Ritchey
2,509,608 A 5/1950 Penfield
2,671,323 A 3/1951 Richert
2,688,369 A 9/1954 Broyles
2,690,897 A 10/1954 Clark
2,711,084 A 6/1955 Bergan
2,719,363 A 10/1955 Richard et al.
2,763,314 A 9/1956 Gill
2,795,279 A 6/1957 Erich
2,799,641 A 7/1957 Gordon
2,805,045 A 9/1957 Goodwin
2,822,150 A 2/1958 Muse et al.
2,832,566 A 4/1958 Bielstein
2,841,226 A 7/1958 Conrad et al.
2,899,000 A 8/1959 Medders et al.
2,927,775 A 3/1960 Hildebrandt
3,016,244 A 1/1962 Friedrich et al.
3,023,507 A 3/1962 Camp
3,028,915 A 4/1962 Jennings
3,071,399 A 1/1963 Cronin
3,087,552 A 4/1963 Graham
3,102,599 A 9/1963 Hillbum
3,103,975 A 9/1963 Hanson
3,104,711 A 9/1963 Haagensen
3,114,875 A 12/1963 Haagensen
3,120,260 A 2/1964 Thompson
3,133,592 A 5/1964 Tomberlin
3,137,347 A 6/1964 Parker
3,145,995 A 8/1964 Bliss et al.
3,149,672 A 9/1964 Joseph et al.
3,169,577 A 2/1965 Erich
3,170,519 A 2/1965 Haagensen
3,211,220 A 10/1965 Erich
3,220,478 A 11/1965 Kinzbach
3,236,307 A 2/1966 Brown
3,253,336 A 5/1966 Brown
3,268,003 A 8/1966 Essary
3,331,439 A 7/1967 Lawrence
3,335,801 A 8/1967 Wilsey
3,428,125 A 2/1969 Parker
3,468,373 A 9/1969 Smith
3,522,848 A 8/1970 New
3,547,192 A 12/1970 Claridge et al.
3,547,193 A 12/1970 Gill
3,557,875 A 1/1971 Solum et al.
3,632,369 A 1/1972 Hahn et al.
3,642,066 A 2/1972 Gill
3,656,564 A 4/1972 Brown
3,696,866 A 10/1972 Dryden
3,807,932 A 4/1974 Dewald
3,827,295 A 8/1974 Rochon
3,832,851 A 9/1974 Kiernan
3,839,791 A 10/1974 Feamster
3,854,032 A 12/1974 Cooper
3,862,662 A 1/1975 Kern
3,874,450 A 4/1975 Kern
3,918,411 A 11/1975 Wolowodiuk
3,931,856 A 1/1976 Barnes
3,946,809 A 3/1976 Hagedorn
3,948,319 A 4/1976 Pritchett
4,008,762 A 2/1977 Fisher et al.
4,010,799 A 3/1977 Kern et al.
4,017,480 A 4/1977 Baum
4,058,163 A 11/1977 Yandell
4,064,211 A 12/1977 Wood
4,084,637 A 4/1978 Todd
4,098,126 A 7/1978 Howard
4,129,437 A 12/1978 Taguchi et al.
4,135,579 A 1/1979 Rowland et al.
4,140,179 A 2/1979 Kasevich et al.
4,140,180 A 2/1979 Bridges et al.
4,144,935 A 3/1979 Bridges et al.
4,191,493 A 3/1980 Hansson et al.
4,193,448 A 3/1980 Jeambey
4,193,451 A 3/1980 Dauphine
4,196,329 A 4/1980 Rowland et al.
4,199,025 A 4/1980 Carpenter
4,255,165 A 3/1981 Dennis et al.
4,265,307 A 5/1981 Elkins
RE30,738 E 9/1981 Bridges et al.
4,287,957 A 9/1981 Evans
4,298,077 A 11/1981 Emery
4,301,865 A 11/1981 Kasevich et al.
4,316,506 A 2/1982 Poole
4,320,801 A 3/1982 Rowland et al.
4,334,928 A 6/1982 Hara
4,337,653 A 7/1982 Chauffe
4,343,651 A 8/1982 Yazu et al.
4,354,559 A 10/1982 Johnson
4,357,520 A 11/1982 Taylor
4,365,677 A 12/1982 Owens
4,373,581 A 2/1983 Toellner
4,384,625 A 5/1983 Roper et al.
4,384,730 A 5/1983 Diehl
4,394,170 A 7/1983 Sawaoka et al.
4,394,880 A 7/1983 Faulkner
4,396,062 A 8/1983 Iskander
4,399,873 A 8/1983 Lindsey, Jr.
4,407,136 A 10/1983 Kanter
4,408,486 A 10/1983 Rochon
4,412,585 A 11/1983 Bouck
4,413,642 A 11/1983 Smith et al.
4,449,585 A 5/1984 Bridges et al.
4,457,365 A 7/1984 Kasevich et al.
4,458,761 A 7/1984 Van Vreeswyk
4,464,993 A 8/1984 Porter
4,470,459 A 9/1984 Copland
4,476,926 A 10/1984 Bridges et al.
4,482,014 A 11/1984 Allwin et al.
4,484,627 A 11/1984 Perkins
4,485,868 A 12/1984 Sresty et al.
4,485,869 A 12/1984 Sresty et al.
4,487,257 A 12/1984 Dauphine
4,495,990 A 1/1985 Titus et al.
4,498,535 A 2/1985 Bridges
4,499,948 A 2/1985 Perkins
4,501,337 A 2/1985 Dickinson et al.
4,508,168 A 4/1985 Heeren
4,513,815 A 4/1985 Rundell et al.
4,516,932 A 5/1985 Chaudot
4,524,826 A 6/1985 Savage
4,524,827 A 6/1985 Bridges et al.
4,525,178 A 6/1985 Hall
4,545,435 A 10/1985 Bridges et al.
4,553,429 A 11/1985 Evans
4,553,592 A 11/1985 Looney et al.
4,557,327 A 12/1985 Kinley et al.
4,576,231 A 3/1986 Dowling et al.
4,583,589 A 4/1986 Kasevich
4,592,423 A 6/1986 Savage et al.
4,593,560 A 6/1986 Purfurst
4,612,988 A 9/1986 Segalman
4,620,593 A 11/1986 Haagensen
4,621,186 A 11/1986 Taylor et al.
4,636,934 A 1/1987 Schwendemann
RE32,345 E 3/1987 Wood
4,646,842 A 3/1987 Arnold et al.
4,660,636 A 4/1987 Rundell et al.
4,674,569 A 6/1987 Revils et al.
4,681,159 A 7/1987 Allwin et al.
4,693,328 A 9/1987 Furse et al.
4,705,108 A 11/1987 Little et al.
4,754,641 A 7/1988 Orban et al.
4,807,484 A 2/1989 Goedecke
4,817,711 A 4/1989 Jearnbey
4,836,289 A 6/1989 Young
4,852,654 A 8/1989 Buckner
4,855,820 A 8/1989 Barbour
4,887,464 A 12/1989 Tannenbaum et al.
4,890,682 A 1/1990 Worrall et al.
4,943,488 A 7/1990 Sung et al.
4,944,348 A 7/1990 Whiteley et al.
4,945,073 A 7/1990 Dubensky et al.

(56) References Cited

U.S. PATENT DOCUMENTS 4,955,237 A 9/1990 Suzuki et al.
4,993,493 A 2/1991 Arnold
5,012,863 A 5/1991 Springer
5,018,580 A 5/1991 Skipper
5,037,704 A 8/1991 Nakai et al.
5,055,180 A 10/1991 Klaila
5,057,004 A 10/1991 McAllister
5,068,819 A 11/1991 Misra et al.
5,070,952 A 12/1991 Neff
5,074,355 A 12/1991 Lennon
5,075,014 A 12/1991 Sullivan
5,082,054 A 1/1992 Kiamanesh
5,092,056 A 3/1992 Deaton
5,096,465 A 3/1992 Chen et al.
5,107,705 A 4/1992 Wraight et al.
5,107,931 A 4/1992 Valka et al.
5,152,342 A 10/1992 Rankin et al.
5,228,518 A 7/1993 Wilson et al.
5,236,039 A 8/1993 Edelstein et al.
5,278,550 A 1/1994 Rhein-Knudsen et al.
5,326,380 A 7/1994 Yao et al.
5,370,195 A 12/1994 Keshavan et al.
5,387,776 A 2/1995 Preiser
5,388,648 A 2/1995 Jordan, Jr.
5,390,742 A 2/1995 Dines et al.
5,407,020 A 4/1995 Beavers
5,429,198 A 7/1995 Anderson et al.
5,490,598 A 2/1996 Adams
5,501,248 A 3/1996 Kiest, Jr.
5,523,158 A 6/1996 Kapoor et al.
5,595,252 A 1/1997 O'Hanlon
5,603,070 A 2/1997 Cerutti et al.
5,616,265 A 4/1997 Altman
5,690,826 A 11/1997 Cravello
5,803,186 A 9/1998 Berger et al.
5,803,666 A 9/1998 Keller
5,805,765 A 9/1998 Altman
5,813,480 A 9/1998 Zaleski, Jr. et al.
5,840,100 A 11/1998 Arencibia
5,853,049 A 12/1998 Keller
5,890,540 A 4/1999 Pia et al.
5,899,274 A 5/1999 Frauenfeld et al.
5,947,213 A 9/1999 Angle
5,955,666 A 9/1999 Mullins
5,958,236 A 9/1999 Bakula
RE36,362 E 11/1999 Jackson
5,987,385 A 11/1999 Varsamis et al.
6,008,153 A 12/1999 Kukino et al.
6,009,948 A 1/2000 Flanders et al.
6,012,526 A 1/2000 Jennings et al.
RE36,556 E 2/2000 Smith
6,032,742 A 3/2000 Tomlin et al.
6,041,860 A 3/2000 Nazzal et al.
6,047,239 A 4/2000 Berger et al.
6,096,436 A 8/2000 Inspektor
6,152,221 A 11/2000 Carmicheal et al.
6,163,257 A 12/2000 Tracy
6,170,531 B1 1/2001 Jung et al.
6,173,795 B1 1/2001 McGarian et al.
6,189,611 B1 2/2001 Kasevich
6,234,250 B1 5/2001 Green et al.
6,254,844 B1 7/2001 Takeuchi et al.
6,268,726 B1 7/2001 Prammer
6,269,953 B1 8/2001 Seyffert et al.
6,287,079 B1 9/2001 Gosling et al.
6,290,068 B1 9/2001 Adams et al.
6,305,471 B1 10/2001 Milloy
6,321,596 B1 11/2001 Newman
6,325,216 B1 12/2001 Seyffert et al.
6,328,111 B1 12/2001 Bearden et al.
6,330,913 B1 12/2001 Langseth et al.
6,354,371 B1 3/2002 O'Blanc
6,371,302 B1 4/2002 Adams et al.
6,371,306 B2 4/2002 Adams et al.
6,378,627 B1 4/2002 Tubel et al.
6,378,628 B1 4/2002 McGuire et al.
6,413,399 B1 7/2002 Kasevich
6,443,228 B1 9/2002 Aronstam
6,454,099 B1 9/2002 Adams et al.
6,469,278 B1 10/2002 Boyce
6,510,947 B1 1/2003 Schulte et al.
6,534,980 B2 2/2003 Toufaily et al.
6,527,066 B1 3/2003 Rives
6,544,411 B2 4/2003 Varandaraj
6,550,534 B2 4/2003 Brett
6,557,630 B2 5/2003 Harkins et al.
6,561,269 B1 5/2003 Brown et al.
6,571,877 B1 6/2003 Van Bilderbeek
6,577,244 B1 6/2003 Clark et al.
6,607,080 B2 8/2003 Winkler et al.
6,612,384 B1 9/2003 Singh et al.
6,622,554 B2 9/2003 Manke et al.
6,623,850 B2 9/2003 Kukino et al.
6,629,610 B1 10/2003 Adams et al.
6,637,092 B1 10/2003 Menzel
6,662,110 B1 12/2003 Bargach et al.
6,678,616 B1 1/2004 Winkler et al.
6,684,953 B2 2/2004 Sonnier
6,691,779 B1 2/2004 Sezginer et al.
6,722,504 B2 4/2004 Schulte et al.
6,739,398 B1 5/2004 Yokley et al.
6,741,000 B2 5/2004 Newcomb
6,752,216 B2 6/2004 Coon
6,761,230 B2 7/2004 Cross et al.
6,814,141 B2 11/2004 Huh et al.
6,827,145 B2 12/2004 Fotland et al.
6,845,818 B2 1/2005 Tutuncu et al.
6,850,068 B2 2/2005 Chernali et al.
6,873,267 B1 3/2005 Tubel et al.
6,895,678 B2 5/2005 Ash et al.
6,899,178 B2 5/2005 Tubel
6,912,177 B2 6/2005 Smith
6,938,698 B2 9/2005 Coronado
6,971,265 B1 12/2005 Sheppard et al.
6,993,432 B2 1/2006 Jenkins et al.
7,000,777 B2 2/2006 Adams et al.
7,013,992 B2 3/2006 Tessari et al.
7,048,051 B2 5/2006 McQueen
7,063,155 B2 6/2006 Ruttley
7,066,281 B2 6/2006 Grotendorst
7,086,463 B2 8/2006 Ringgenberg et al.
7,091,460 B2 8/2006 Kinzer
7,109,457 B2 9/2006 Kinzer
7,115,847 B2 10/2006 Kinzer
7,124,819 B2 10/2006 Ciglenec et al.
7,131,498 B2 11/2006 Campo et al.
7,145,114 B2 12/2006 Wakamatu
7,216,767 B2 5/2007 Schulte et al.
7,219,730 B2 5/2007 Tilton et al.
7,228,902 B2 6/2007 Oppelt
7,243,735 B2 7/2007 Koederitz et al.
7,252,152 B2 8/2007 LoGiudice et al.
7,255,582 B1 8/2007 Liao
7,267,179 B1 9/2007 Abel
7,278,492 B2 10/2007 Braddick
7,312,428 B2 12/2007 Kinzer
7,322,776 B2 1/2008 Webb et al.
7,331,385 B2 2/2008 Symington
7,334,634 B1 2/2008 Abel
7,376,514 B2 5/2008 Habashy et al.
7,387,174 B2 6/2008 Lurie
7,395,878 B2 7/2008 Reitsma et al.
7,419,001 B2 9/2008 Broussard
7,441,610 B2 10/2008 Belnap et al.
7,445,041 B2 11/2008 O'Brien
7,455,117 B1 11/2008 Hall et al.
7,461,693 B2 12/2008 Considine et al.
7,484,561 B2 2/2009 Bridges
7,487,837 B2 2/2009 Bailey et al.
7,539,548 B2 5/2009 Dhawan
7,562,708 B2 7/2009 Cogliandro et al.
7,581,440 B2 9/2009 Meek
7,629,497 B2 12/2009 Pringle
7,631,691 B2 12/2009 Symington et al.

(56) References Cited

U.S. PATENT DOCUMENTS 7,645,513 B2 1/2010 Bello et al.
7,647,964 B2 1/2010 Akbar et al.
7,647,980 B2 1/2010 Corre et al.
7,647,992 B2 1/2010 Fang et al.
7,650,269 B2 1/2010 Rodney
7,654,334 B2 2/2010 Manson
7,665,537 B2 2/2010 Patel et al.
7,677,303 B2 3/2010 Coronado
7,677,673 B2 3/2010 Tranquilla et al.
7,730,625 B2 6/2010 Blake
7,757,757 B1 * 7/2010 Vroblesky ..... E21B 49/084 166/192
7,779,903 B2 8/2010 Bailey et al.
7,789,148 B2 9/2010 Rayssiguier et al.
7,806,173 B2 10/2010 Kaul et al.
7,823,663 B2 11/2010 Eddison
7,828,057 B2 11/2010 Kearl et al.
7,909,096 B2 3/2011 Clark et al.
7,938,192 B2 5/2011 Rytlewski
7,940,302 B2 5/2011 Mehrotra et al.
7,951,482 B2 5/2011 Ichinose et al.
7,967,066 B2 6/2011 McStay et al.
7,980,392 B2 7/2011 Varco
8,028,763 B2 10/2011 Mackenzie
8,028,767 B2 10/2011 Radford et al.
8,067,865 B2 11/2011 Savant
8,071,173 B1 12/2011 Sani
8,096,349 B2 1/2012 Considine et al.
8,102,238 B2 1/2012 Golander et al.
8,127,856 B1 3/2012 Nish et al.
8,176,977 B2 5/2012 Keller
8,191,635 B2 6/2012 Buske et al.
8,210,256 B2 7/2012 Bridges et al.
8,237,444 B2 8/2012 Simon
8,237,585 B2 8/2012 Zimmerman
8,245,792 B2 8/2012 Trinh et al.
8,275,549 B2 9/2012 Sabag et al.
8,286,734 B2 10/2012 Hannegan et al.
8,334,775 B2 12/2012 Tapp et al.
8,424,605 B1 4/2013 Schultz et al.
8,448,724 B2 5/2013 Buske et al.
8,469,084 B2 6/2013 Clark et al.
8,484,858 B2 7/2013 Brannigan et al.
8,511,404 B2 8/2013 Rasheed
8,512,865 B2 8/2013 DiGiovanni
8,526,171 B2 9/2013 Wu et al.
8,528,668 B2 9/2013 Rasheed
8,540,035 B2 9/2013 Xu et al.
8,550,174 B1 10/2013 Orgeron et al.
8,567,491 B2 10/2013 Lurie
8,636,063 B2 1/2014 Ravi et al.
8,657,018 B2 2/2014 Cravatte
8,678,087 B2 3/2014 Schultz et al.
8,683,859 B2 4/2014 Godager
8,734,552 B1 5/2014 Vail et al.
8,750,513 B2 6/2014 Renkis
8,776,609 B2 7/2014 Dria et al.
8,789,585 B2 7/2014 Leising et al.
8,794,062 B2 8/2014 DiFoggio et al.
8,800,655 B1 8/2014 Bailey
8,800,880 B2 8/2014 Christiansen
8,824,240 B2 9/2014 Roberts et al.
8,833,472 B2 9/2014 Hay
8,884,624 B2 11/2014 Homan et al.
8,919,431 B2 12/2014 Lott
8,925,213 B2 1/2015 Sallwasser
8,936,009 B2 1/2015 Hu
8,960,215 B2 2/2015 Cui et al.
8,973,680 B2 3/2015 MacKenzie
8,991,489 B2 3/2015 Redlinger et al.
9,051,792 B2 6/2015 Herberg et al.
9,051,810 B1 6/2015 Cuffe et al.
9,091,148 B2 7/2015 Moffitt et al.
9,109,429 B2 8/2015 Xu et al.
9,115,573 B2 8/2015 Purkis et al.
9,121,255 B2 9/2015 Themig et al.
9,140,100 B2 9/2015 Daccord et al.
9,157,294 B2 10/2015 Kleppa et al.
9,187,959 B2 11/2015 Treviranus et al.
9,208,676 B2 12/2015 Fadell et al.
9,217,291 B2 12/2015 Batarseh
9,217,323 B2 12/2015 Clark
9,222,350 B2 12/2015 Vaughn et al.
9,238,953 B2 1/2016 Fleming et al.
9,238,961 B2 1/2016 Bedouet
9,250,339 B2 2/2016 Ramirez
9,253,824 B2 2/2016 Inoue
9,328,574 B2 5/2016 Sehsah
9,341,027 B2 5/2016 Radford et al.
9,353,589 B2 5/2016 Hekelaar
9,355,440 B1 5/2016 Chen et al.
9,394,782 B2 7/2016 DiGiovanni et al.
9,435,159 B2 9/2016 Scott
9,464,487 B1 10/2016 Zurn
9,470,059 B2 10/2016 Zhou
9,488,046 B2 11/2016 Purkis
9,492,885 B2 11/2016 Zediker et al.
9,494,003 B1 11/2016 Can-
9,494,010 B2 11/2016 Flores
9,494,032 B2 11/2016 Roberson et al.
9,506,318 B1 11/2016 Brunet
9,528,366 B2 12/2016 Selman et al.
9,546,536 B2 1/2017 Schultz et al.
9,562,987 B2 2/2017 Guner et al.
9,567,819 B2 2/2017 Cavender et al.
9,574,439 B2 2/2017 Joseph et al.
9,611,697 B2 4/2017 Radford et al.
9,617,815 B2 4/2017 Schwartze et al.
9,664,011 B2 5/2017 Kruspe et al.
9,702,211 B2 7/2017 Tinnen
9,731,471 B2 8/2017 Schaedler et al.
9,739,141 B2 8/2017 Zeng et al.
9,757,796 B2 9/2017 Sherman et al.
9,765,609 B2 9/2017 Chemali et al.
9,784,073 B2 10/2017 Bailey et al.
9,845,653 B2 12/2017 Hannegan et al.
9,903,010 B2 2/2018 Doud et al.
9,976,381 B2 5/2018 Martin et al.
10,000,983 B2 6/2018 Jackson et al.
10,024,154 B2 7/2018 Gray et al.
10,113,408 B2 10/2018 Pobedinski et al.
10,118,223 B2 11/2018 Eason
10,174,577 B2 1/2019 Leuchtenberg et al.
10,179,390 B2 1/2019 Mukhopadhyay et al.
10,233,372 B2 3/2019 Ramasamy et al.
10,302,083 B2 5/2019 Downton
10,329,877 B2 6/2019 Simpson et al.
10,352,125 B2 7/2019 Frazier
10,392,910 B2 8/2019 Walton et al.
10,394,193 B2 8/2019 Li et al.
10,544,640 B2 1/2020 Hekelaar
10,551,800 B2 2/2020 Li et al.
10,641,079 B2 5/2020 Aljubran et al.
10,673,238 B2 6/2020 Boone et al.
10,927,618 B2 2/2021 Albahrani et al.
10,954,739 B2 3/2021 Sehsah et al.
10,999,946 B2 5/2021 Li et al.
11,008,241 B2 5/2021 Carew
11,008,816 B2 5/2021 Zhan et al.
11,078,780 B2 8/2021 Gooneratne et al.
11,111,732 B2 9/2021 Zhan et al.
11,125,046 B2 9/2021 Li et al.
11,125,075 B1 9/2021 Li et al.
11,125,431 B2 9/2021 Umair et al.
11,136,868 B1 10/2021 Alqurashi et al.
11,170,494 B1 11/2021 Nassir et al.
2002/0040812 A1 4/2002 Keying et al.
2002/0053434 A1 5/2002 Chen et al.
2002/0066563 A1 6/2002 Langseth et al.
2002/0070018 A1 6/2002 Buyaert
2002/0148607 A1 10/2002 Pabst
2003/0001753 A1 1/2003 Cernocky et al.
2003/0052098 A1 3/2003 Kim et al.
2003/0118230 A1 6/2003 Song

(56) References Cited

U.S. PATENT DOCUMENTS

2003/0159776 A1 8/2003 Graham
2003/0230526 A1 12/2003 Okabayshi et al.
2004/0060741 A1 4/2004 Shipalesky et al.
2004/0069496 A1 4/2004 Hosie et al.
2004/0089450 A1* 5/2004 Slade ..... E21B 41/0078 166/55.7
2004/0156264 A1 8/2004 Gardner et al.
2004/0173363 A1 9/2004 Navarro-Sorroche
2004/0182574 A1 9/2004 Sarmad et al.
2004/0200550 A1 10/2004 Pfaffman
2004/0255479 A1 12/2004 Moake et al.
2004/0256103 A1 12/2004 Batarseh
2005/0022987 A1 2/2005 Green et al.
2005/0028980 A1 2/2005 Page et al.
2005/0092523 A1 5/2005 McCaskill et al.
2005/0199386 A1 9/2005 Kinzer
2005/0211429 A1* 9/2005 Gray ..... E21B 29/005 166/117.7
2005/0259512 A1 11/2005 Mandal
2005/0273302 A1 12/2005 Huang et al.
2006/0016592 A1 1/2006 Wu
2006/0076347 A1 4/2006 Kinzer
2006/0081375 A1 4/2006 Ruttley
2006/0086497 A1 4/2006 Ohmer et al.
2006/0102625 A1 5/2006 Kinzer
2006/0106541 A1 5/2006 Hassan et al.
2006/0107061 A1 5/2006 Holovacs
2006/0144620 A1 7/2006 Cooper
2006/0185843 A1 8/2006 Smith
2006/0248949 A1 11/2006 Gregory et al.
2006/0249307 A1 11/2006 Ritter
2006/0260799 A1 11/2006 Broussard
2006/0290528 A1 12/2006 MacPherson et al.
2007/0000662 A1 1/2007 Symington et al.
2007/0017669 A1 1/2007 Lurie
2007/0057811 A1 3/2007 Mehta
2007/0107911 A1 5/2007 Miller et al.
2007/0108202 A1 5/2007 Kinzer
2007/0131591 A1 6/2007 Pringle
2007/0137852 A1 6/2007 Considine et al.
2007/0137858 A1 6/2007 Considine et al.
2007/0153626 A1 7/2007 Hayes et al.
2007/0175633 A1 8/2007 Kosmala
2007/0181301 A1 8/2007 O'Brien
2007/0187089 A1 8/2007 Bridges
2007/0187112 A1 8/2007 Eddison et al.
2007/0193744 A1 8/2007 Bridges
2007/0204994 A1 9/2007 Wimmersperg
2007/0251687 A1 11/2007 Martinez et al.
2007/0261629 A1 11/2007 Choi
2007/0261844 A1 11/2007 Cogliandro et al.
2007/0261855 A1 11/2007 Brunet
2007/0289736 A1 12/2007 Kearl et al.
2008/0007421 A1 1/2008 Liu et al.
2008/0041631 A1 2/2008 Vail, III
2008/0047337 A1 2/2008 Chemali et al.
2008/0053652 A1 3/2008 Corre et al.
2008/0073079 A1 3/2008 Tranquilla et al.
2008/0115574 A1 5/2008 Meek
2008/0135494 A1 6/2008 Usher
2008/0173443 A1 7/2008 Symington et al.
2008/0173480 A1 7/2008 Annaiyappa et al.
2008/0190822 A1 8/2008 Young
2008/0223579 A1 9/2008 Goodwin
2008/0308279 A1 12/2008 Zazovsky et al.
2008/0308282 A1 12/2008 Standridge et al.
2008/0312892 A1 12/2008 Heggemann
2009/0032308 A1 2/2009 Eddison
2009/0045974 A1 2/2009 Patel
2009/0050333 A1 2/2009 Smith
2009/0114448 A1 5/2009 Laird et al.
2009/0153354 A1 6/2009 Daussin
2009/0159334 A1 6/2009 Alberty
2009/0164125 A1 6/2009 Bordakov et al.
2009/0178809 A1 7/2009 Jeffryes et al.
2009/0183875 A1 7/2009 Rayssiguier et al.
2009/0192731 A1 7/2009 De Jesus et al.
2009/0223670 A1 9/2009 Snider
2009/0255689 A1 10/2009 Kriesels et al.
2009/0259446 A1 10/2009 Zhang et al.
2009/0266544 A1 10/2009 Redlinger et al.
2009/0288820 A1 11/2009 Barron et al.
2009/0289808 A1 11/2009 Prammer
2009/0301723 A1 12/2009 Gray
2010/0006339 A1 1/2010 Desai
2010/0089583 A1 4/2010 Xu et al.
2010/0097205 A1 4/2010 Script
2010/0097450 A1 4/2010 Pugh
2010/0101786 A1 4/2010 Lovell et al.
2010/0175882 A1 7/2010 Bailey et al.
2010/0186955 A1 7/2010 Saasen et al.
2010/0212891 A1 8/2010 Stewart et al.
2010/0212900 A1 8/2010 Eddison et al.
2010/0212901 A1 8/2010 Buytaert
2010/0258289 A1 10/2010 Lynde et al.
2010/0258297 A1 10/2010 Lyndre
2010/0258298 A1 10/2010 Lynde et al.
2010/0276209 A1 11/2010 Yong et al.
2010/0282511 A1 11/2010 Maranuk
2011/0011576 A1 1/2011 Cavender et al.
2011/0024195 A1 2/2011 Hoyer
2011/0031026 A1 2/2011 Oxford et al.
2011/0036596 A1 2/2011 Nguyen et al.
2011/0058916 A1 3/2011 Toosky
2011/0067884 A1 3/2011 Burleson et al.
2011/0073329 A1 3/2011 Clemens et al.
2011/0083908 A1 4/2011 Shen et al.
2011/0088903 A1 4/2011 Onadeko et al.
2011/0100645 A1 5/2011 Yapici
2011/0120732 A1 5/2011 Lurie
2011/0127044 A1 6/2011 Radford et al.
2011/0146967 A1 6/2011 Winslow et al.
2011/0147014 A1 6/2011 Chen et al.
2011/0155368 A1 6/2011 El-Khazindar
2011/0220350 A1 9/2011 Daccord et al.
2011/0220416 A1 9/2011 Rives
2011/0226479 A1 9/2011 Tippel et al.
2011/0240302 A1 10/2011 Coludrovich, III
2011/0266004 A1 11/2011 Hallundbaek et al.
2011/0271603 A1 11/2011 Voronin et al.
2011/0284219 A1 11/2011 Pomerantz
2012/0012319 A1 1/2012 Dennis
2012/0037361 A1 2/2012 Santos
2012/0048619 A1 3/2012 Seutter et al.
2012/0055711 A1 3/2012 Brannigan et al.
2012/0075615 A1 3/2012 Niclass et al.
2012/0085531 A1 4/2012 Leising et al.
2012/0085540 A1 4/2012 Heijnen
2012/0111578 A1 5/2012 Tverlid
2012/0127829 A1 5/2012 Sitka
2012/0132418 A1 5/2012 McClung
2012/0132468 A1 5/2012 Scott et al.
2012/0152543 A1 6/2012 Davis
2012/0160512 A1 6/2012 Given et al.
2012/0169841 A1 6/2012 Chemali et al.
2012/0173196 A1 7/2012 Miszewski
2012/0175135 A1 7/2012 Dyer et al.
2012/0181020 A1 7/2012 Barron et al.
2012/0186817 A1 7/2012 Gibson et al.
2012/0211229 A1 8/2012 Fielder
2012/0222854 A1 9/2012 McClung, III
2012/0227983 A1 9/2012 Lymberopoulous et al.
2012/0241154 A1 9/2012 Zhou
2012/0247767 A1 10/2012 Themig et al.
2012/0273187 A1 11/2012 Hall
2012/0307051 A1 12/2012 Welter
2012/0312560 A1 12/2012 Bahr et al.
2012/0325564 A1 12/2012 Vaughn et al.
2013/0008653 A1 1/2013 Schultz et al.
2013/0008671 A1 1/2013 Booth
2013/0025943 A1 1/2013 Kumar
2013/0037268 A1 2/2013 Kleefisch et al.
2013/0068525 A1 3/2013 Digiovanni
2013/0076525 A1 3/2013 Vu et al.

(56) References Cited

U.S. PATENT DOCUMENTS

2013/0125642 A1 5/2013 Parfitt
2013/0126164 A1 5/2013 Sweatman et al.
2013/0128697 A1 5/2013 Contant
2013/0146359 A1 6/2013 Koederitz
2013/0153245 A1 6/2013 Knobloch et al.
2013/0175055 A1 7/2013 Hart
2013/0186645 A1 7/2013 Hall
2013/0191029 A1 7/2013 Heck, Sr.
2013/0213637 A1 8/2013 Kearl
2013/0255936 A1 10/2013 Statoilydro et al.
2013/0269945 A1 10/2013 Mulholland et al.
2013/0284434 A1 10/2013 Marvel
2013/0298696 A1 11/2013 Singfield
2013/0299160 A1 11/2013 Lott
2013/0299241 A1 11/2013 Alberty et al.
2013/0308424 A1 11/2013 Kumar
2014/0034144 A1 2/2014 Cui et al.
2014/0047776 A1 2/2014 Scott et al.
2014/0060844 A1 3/2014 Barbour et al.
2014/0083769 A1 3/2014 Moriarty et al.
2014/0083771 A1 3/2014 Clark
2014/0090846 A1 4/2014 Deutch
2014/0090898 A1 4/2014 Moriarty et al.
2014/0116071 A1 5/2014 Jung et al.
2014/0126330 A1 5/2014 Shampine et al.
2014/0131036 A1 5/2014 Huval et al.
2014/0132468 A1 5/2014 Scott et al.
2014/0139681 A1 5/2014 Jones, Jr. et al.
2014/0158369 A1 6/2014 Radford et al.
2014/0166367 A1 6/2014 Campbell et al.
2014/0172306 A1 6/2014 Brannigan
2014/0183143 A1 7/2014 Cady et al.
2014/0208847 A1 7/2014 Baranov
2014/0231068 A1 8/2014 Isaksen
2014/0231075 A1 8/2014 Springett et al.
2014/0231144 A1 8/2014 Sonar et al.
2014/0231147 A1 8/2014 Bozso et al.
2014/0238658 A1 8/2014 Wilson et al.
2014/0246235 A1 9/2014 Yao
2014/0251593 A1 9/2014 Oberg et al.
2014/0251894 A1 9/2014 Larson et al.
2014/0262211 A1 9/2014 Xu et al.
2014/0265337 A1 9/2014 Harding et al.
2014/0270793 A1 9/2014 Bradford
2014/0272739 A1 9/2014 Hurley
2014/0278111 A1 9/2014 Gerrie et al.
2014/0291023 A1 10/2014 Edbury
2014/0300895 A1 10/2014 Pope et al.
2014/0308203 A1 10/2014 Sheinberg et al.
2014/0318392 A1 10/2014 Sajgalik et al.
2014/0318806 A1 10/2014 Machocki
2014/0326506 A1 11/2014 Difoggio
2014/0333754 A1 11/2014 Graves et al.
2014/0360778 A1 12/2014 Batarseh
2014/0375468 A1 12/2014 Wilkinson et al.
2015/0020908 A1 1/2015 Warren
2015/0021240 A1 1/2015 Wardell et al.
2015/0027706 A1 1/2015 Symms
2015/0027724 A1 1/2015 Symms
2015/0075714 A1 3/2015 Sun et al.
2015/0083422 A1 3/2015 Pritchard
2015/0090459 A1 4/2015 Cain et al.
2015/0091737 A1 4/2015 Richardson et al.
2015/0101863 A1 4/2015 Jeffryes
2015/0101864 A1 4/2015 May
2015/0129306 A1 5/2015 Coffman et al.
2015/0152713 A1 6/2015 Garcia et al.
2015/0159467 A1 6/2015 Hartman et al.
2015/0175452 A1 6/2015 Nedwed et al.
2015/0176362 A1 6/2015 Prieto
2015/0211362 A1 7/2015 Rogers
2015/0267500 A1 9/2015 Van Dongen
2015/0284833 A1 10/2015 Hsiao et al.
2015/0290878 A1 10/2015 Houben et al.
2015/0292270 A1 10/2015 Zhang et al.
2015/0300151 A1 10/2015 Mohaghegh
2015/0308203 A1 10/2015 Lewis
2015/0345254 A1 12/2015 Ciglenec et al.
2015/0345261 A1 12/2015 Kruspe et al.
2015/0354281 A1 12/2015 Schultz et al.
2016/0053566 A1 2/2016 Winkler
2016/0053572 A1 2/2016 Snoswell
2016/0053604 A1 2/2016 Abbassian
2016/0076339 A1 3/2016 Martin et al.
2016/0076357 A1 3/2016 Hbaieb
2016/0115783 A1 4/2016 Zeng et al.
2016/0130928 A1 5/2016 Torrione et al.
2016/0130931 A1* 5/2016 Lou ..... E21B 7/00 175/40
2016/0153240 A1 6/2016 Braga et al.
2016/0160106 A1 6/2016 Jamison et al.
2016/0160578 A1 6/2016 Lee
2016/0186519 A1 6/2016 Krejci
2016/0194157 A1 7/2016 Senn et al.
2016/0215612 A1 7/2016 Morrow
2016/0230508 A1 8/2016 Jensen
2016/0237764 A1 8/2016 Jellison et al.
2016/0237768 A1 8/2016 Jamison et al.
2016/0237810 A1 8/2016 Beaman et al.
2016/0247316 A1 8/2016 Whalley et al.
2016/0251931 A1 9/2016 Buchan et al.
2016/0312565 A1 10/2016 Papadimitriou
2016/0339517 A1 11/2016 Joshi et al.
2016/0356111 A1 12/2016 Castillo et al.
2016/0356125 A1 12/2016 Bello et al.
2016/0356152 A1 12/2016 Croux
2017/0051785 A1 2/2017 Cooper
2017/0058620 A1 3/2017 Torrione
2017/0067318 A1 3/2017 Haugland
2017/0074071 A1 3/2017 Tzallas et al.
2017/0077705 A1 3/2017 Kuttel et al.
2017/0089153 A1 3/2017 Teodorescu
2017/0159363 A1 6/2017 Lazarev et al.
2017/0159365 A1 6/2017 Solem
2017/0161885 A1 6/2017 Parmeshwar et al.
2017/0175446 A1 6/2017 Fraser et al.
2017/0184389 A1 6/2017 Zhang et al.
2017/0198538 A1 7/2017 Hansen et al.
2017/0234104 A1 8/2017 James
2017/0235848 A1 8/2017 Van Dusen et al.
2017/0242146 A1* 8/2017 Itskovich ..... E21B 49/00
2017/0284194 A1 10/2017 Logan
2017/0292376 A1 10/2017 Kumar et al.
2017/0314335 A1 11/2017 Kosonde et al.
2017/0314369 A1 11/2017 Rosano et al.
2017/0328196 A1 11/2017 Shi et al.
2017/0328197 A1 11/2017 Shi et al.
2017/0332482 A1 11/2017 Hauslmann
2017/0342776 A1 11/2017 Bullock et al.
2017/0350201 A1 12/2017 Shi et al.
2017/0350241 A1 12/2017 Shi
2018/0010030 A1 1/2018 Ramasamy et al.
2018/0010419 A1 1/2018 Livescu et al.
2018/0029942 A1 2/2018 Ishida
2018/0030810 A1 2/2018 Saldanha
2018/0067228 A1 3/2018 Nali et al.
2018/0086962 A1 3/2018 Amanullah
2018/0126516 A1 5/2018 Kanyanta et al.
2018/0171772 A1 6/2018 Rodney
2018/0171774 A1 6/2018 Ringer et al.
2018/0177064 A1 6/2018 Van Pol et al.
2018/0187498 A1 7/2018 Soto et al.
2018/0202234 A1 7/2018 Saini et al.
2018/0208511 A1 7/2018 Liang et al.
2018/0230360 A1 8/2018 Walker et al.
2018/0230767 A1 8/2018 Sehsah et al.
2018/0240322 A1 8/2018 Potucek et al.
2018/0265416 A1 9/2018 Ishida et al.
2018/0266226 A1 9/2018 Batarseh et al.
2018/0282230 A1 10/2018 Oh et al.
2018/0315111 A1 11/2018 Alvo et al.
2018/0326679 A1 11/2018 Weisenberg et al.
2018/0334883 A1 11/2018 Williamson
2018/0363404 A1 12/2018 Faugstad

(56) References Cited

U.S. PATENT DOCUMENTS

| | | | |
|---|---|---|---|
| 2019/0009033 | A1 | 1/2019 | Butler et al. |
| 2019/0030673 | A1 | 1/2019 | Pereira |
| 2019/0049054 | A1 | 2/2019 | Gunnarsson et al. |
| 2019/0078390 | A1 | 3/2019 | Belnap et al. |
| 2019/0078426 | A1 | 3/2019 | Zheng et al. |
| 2019/0078626 | A1 | 3/2019 | Silsson |
| 2019/0090056 | A1 | 3/2019 | Rexach et al. |
| 2019/0090330 | A1 | 3/2019 | Aykroyd et al. |
| 2019/0100988 | A1 | 4/2019 | Brian et al. |
| 2019/0101872 | A1 | 4/2019 | Li |
| 2019/0145183 | A1 | 5/2019 | Potash |
| 2019/0147125 | A1 | 5/2019 | Yu et al. |
| 2019/0194519 | A1 | 6/2019 | Amanullah |
| 2019/0227499 | A1 | 7/2019 | Li et al. |
| 2019/0257180 | A1 | 8/2019 | Kriesels et al. |
| 2019/0267805 | A1 | 8/2019 | Kothuru et al. |
| 2019/0282089 | A1 | 9/2019 | Wang |
| 2019/0301244 | A1 | 10/2019 | Moore et al. |
| 2019/0323332 | A1 | 10/2019 | Cuellar et al. |
| 2019/0345779 | A1 | 11/2019 | Kennedy et al. |
| 2019/0345816 | A1* | 11/2019 | Auchere ..... E21B 44/02 |
| 2019/0368295 | A1 | 12/2019 | Machocki et al. |
| 2020/0032638 | A1 | 1/2020 | Ezzeddine |
| 2020/0081439 | A1 | 3/2020 | Mukhetjee et al. |
| 2020/0125040 | A1 | 4/2020 | Li et al. |
| 2020/0157929 | A1 | 5/2020 | Torrione |
| 2020/0182043 | A1 | 6/2020 | Downey et al. |
| 2020/0190959 | A1 | 6/2020 | Gooneratne et al. |
| 2020/0190963 | A1 | 6/2020 | Gooneratne et al. |
| 2020/0190967 | A1 | 6/2020 | Gooneratne et al. |
| 2020/0199968 | A1 | 6/2020 | Manett |
| 2020/0240258 | A1 | 7/2020 | Stokely et al. |
| 2020/0248546 | A1 | 8/2020 | Torrione et al. |
| 2020/0368967 | A1 | 11/2020 | Zhan et al. |
| 2020/0370381 | A1 | 11/2020 | Al-Rubaii et al. |
| 2020/0371495 | A1 | 11/2020 | Al-Rubaii et al. |
| 2021/0003280 | A1 | 1/2021 | Umair et al. |
| 2021/0032934 | A1 | 2/2021 | Zhan et al. |
| 2021/0032935 | A1 | 2/2021 | Zhan et al. |
| 2021/0032936 | A1 | 2/2021 | Zhan et al. |
| 2021/0034029 | A1 | 2/2021 | Zhan et al. |
| 2021/0040702 | A1 | 2/2021 | Sehsah et al. |
| 2021/0062633 | A1 | 3/2021 | Amoudi et al. |
| 2021/0115747 | A1 | 4/2021 | Stokes et al. |
| 2021/0172269 | A1 | 6/2021 | Li et al. |
| 2021/0172270 | A1 | 6/2021 | Li et al. |
| 2021/0172281 | A1 | 6/2021 | Li et al. |
| 2021/0246779 | A1 | 8/2021 | Adebiyi |
| 2021/0301597 | A1 | 9/2021 | Li et al. |
| 2021/0301604 | A1 | 9/2021 | Li et al. |
| 2021/0301605 | A1 | 9/2021 | Li et al. |
| 2021/0301631 | A1 | 9/2021 | Li et al. |
| 2021/0301648 | A1 | 9/2021 | Li et al. |
| 2021/0301649 | A1 | 9/2021 | Li et al. |
| 2021/0340866 | A1 | 11/2021 | Zhan et al. |
| 2021/0350519 | A1 | 11/2021 | Nassir et al. |
| 2021/0370396 | A1 | 12/2021 | Zhan et al. |
| 2021/0371345 | A1 | 12/2021 | Zhan et al. |
| 2021/0372269 | A1 | 12/2021 | Gooneratne et al. |
| 2021/0372270 | A1 | 12/2021 | Gooneratne et al. |
| 2021/0376373 | A1 | 12/2021 | Zhan et al. |
| 2021/0388683 | A1 | 12/2021 | Li et al. |
| 2021/0388684 | A1 | 12/2021 | Li et al. |
| 2021/0388685 | A1 | 12/2021 | Li et al. |
| 2022/0018241 | A1 | 1/2022 | Affleck |
| 2022/0034186 | A1 | 2/2022 | Sehsah et al. |

FOREIGN PATENT DOCUMENTS

| | | |
|---|---|---|
| CA | 1226325 | 9/1987 |
| CA | 2249432 | 9/2005 |
| CA | 2537585 | 8/2006 |
| CA | 2669721 | 7/2011 |
| CA | 2594042 | 8/2012 |
| CA | 2985258 | 5/2018 |
| CN | 2241221 | 11/1996 |
| CN | 2379603 | 5/2000 |
| CN | 2763455 | 3/2006 |
| CN | 101079591 | 11/2007 |
| CN | 200989202 | 12/2007 |
| CN | 102322415 | 1/2012 |
| CN | 102359353 | 2/2012 |
| CN | 102493813 | 6/2012 |
| CN | 202300959 | 7/2012 |
| CN | 102822752 | 12/2012 |
| CN | 202645492 | 1/2013 |
| CN | 102953711 | 3/2013 |
| CN | 203232293 | 10/2013 |
| CN | 103558123 | 2/2014 |
| CN | 103857872 | 6/2014 |
| CN | 104126051 | 10/2014 |
| CN | 102187047 | 12/2014 |
| CN | 104295448 | 1/2015 |
| CN | 204177988 | 2/2015 |
| CN | 104405304 | 3/2015 |
| CN | 204252828 | 4/2015 |
| CN | 204627586 | 9/2015 |
| CN | 105464606 | 4/2016 |
| CN | 106119763 | 11/2016 |
| CN | 106285483 | 1/2017 |
| CN | 106761568 | 5/2017 |
| CN | 107208478 | 9/2017 |
| CN | 107462222 | 12/2017 |
| CN | 108240191 | 7/2018 |
| CN | 108470856 | 8/2018 |
| CN | 109437920 | 3/2019 |
| CN | 110571475 | 12/2019 |
| DE | 102005026534 | 12/2006 |
| DE | 102008001607 | 11/2009 |
| DE | 102011008809 | 7/2012 |
| DE | 102012022453 | 5/2014 |
| DE | 102013200450 | 7/2014 |
| DE | 102012205757 | 8/2014 |
| EP | 0255619 | 2/1988 |
| EP | 0377234 | 10/1989 |
| EP | 0437855 | 7/1991 |
| EP | 0437872 | 7/1991 |
| EP | 0618345 | 10/1994 |
| EP | 1241321 | 9/2002 |
| EP | 2157278 | 2/2010 |
| EP | 2317068 | 5/2011 |
| EP | 2574722 | 4/2013 |
| EP | 2692982 | 5/2014 |
| EP | 2737173 | 6/2014 |
| EP | 2835493 | 2/2015 |
| EP | 3034778 | 6/2016 |
| EP | 3284900 | 2/2018 |
| EP | 3333141 | 6/2018 |
| FR | 3051699 | 12/2017 |
| GB | 1572460 | 7/1980 |
| GB | 1574615 | 9/1980 |
| GB | 2124855 | 2/1984 |
| GB | 2155519 | 9/1985 |
| GB | 2157743 | 10/1985 |
| GB | 2261238 | 12/1993 |
| GB | 2357305 | 6/2001 |
| GB | 2399515 | 9/2004 |
| GB | 2422125 | 7/2006 |
| GB | 2460096 | 11/2009 |
| GB | 2466376 | 6/2010 |
| GB | 2470762 | 12/2010 |
| GB | 2484166 | 4/2012 |
| GB | 2532967 | 6/2016 |
| JP | S 62274034 | 11/1987 |
| JP | 2009067609 | 4/2009 |
| JP | 4275896 | 6/2009 |
| JP | 5013156 | 8/2012 |
| JP | 2013110910 | 6/2013 |
| KR | 1020170050280 | 5/2017 |
| NO | 20151342 | 4/2017 |
| NO | 343139 | 11/2018 |
| NO | 20161842 | 5/2019 |
| RU | 2282708 | 8/2006 |
| RU | 122531 | 11/2012 |

(56) References Cited

FOREIGN PATENT DOCUMENTS

| | | |
|---|---|---|
| WO | WO 1981003295 | 11/1981 |
| WO | WO 1994021889 | 9/1994 |
| WO | WO 1995035429 | 12/1995 |
| WO | WO 1997021904 | 6/1997 |
| WO | WO 1998007955 | 2/1998 |
| WO | WO 1999036658 | 7/1999 |
| WO | WO 2000025942 | 5/2000 |
| WO | WO 2000031374 | 6/2000 |
| WO | WO 2001042622 | 6/2001 |
| WO | WO 2002020944 | 3/2002 |
| WO | WO 2002068793 | 9/2002 |
| WO | WO 2003042494 | 5/2003 |
| WO | WO 2003058545 | 7/2003 |
| WO | WO 2004042185 | 5/2004 |
| WO | WO 2006032984 | 3/2006 |
| WO | WO 2007049026 | 5/2007 |
| WO | WO 2007070305 | 6/2007 |
| WO | WO 2008146017 | 12/2008 |
| WO | WO 2009020889 | 2/2009 |
| WO | WO 2009113895 | 9/2009 |
| WO | WO 2010054353 | 5/2010 |
| WO | WO 2010105177 | 9/2010 |
| WO | WO 2011038170 | 3/2011 |
| WO | WO 2011042622 | 6/2011 |
| WO | WO 2011142622 | 6/2011 |
| WO | WO 2011095600 | 8/2011 |
| WO | WO 2011130159 | 10/2011 |
| WO | WO 201113 9697 | 11/2011 |
| WO | WO 2011159890 | 12/2011 |
| WO | WO 2012007407 | 1/2012 |
| WO | WO 2012155018 | 11/2012 |
| WO | WO 2013016095 | 1/2013 |
| WO | WO 2013148510 | 10/2013 |
| WO | WO 2014127035 | 8/2014 |
| WO | WO 2015072971 | 5/2015 |
| WO | WO 2015095155 | 6/2015 |
| WO | WO 2016144345 | 9/2016 |
| WO | WO 2016178005 | 11/2016 |
| WO | WO 2016200395 | 12/2016 |
| WO | WO 2017011078 | 1/2017 |
| WO | WO 2017027105 | 2/2017 |
| WO | WO 2017132297 | 8/2017 |
| WO | WO 2017196303 | 11/2017 |
| WO | WO 2018022198 | 2/2018 |
| WO | WO 2018046361 | 3/2018 |
| WO | WO 2018167022 | 9/2018 |
| WO | WO 2018169991 | 9/2018 |
| WO | WO 2018176106 | 10/2018 |
| WO | WO 2018231273 | 12/2018 |
| WO | WO 2019027830 | 2/2019 |
| WO | WO 2019040091 | 2/2019 |
| WO | WO 2019055240 | 3/2019 |
| WO | WO 2019086918 | 5/2019 |
| WO | WO 2019089926 | 5/2019 |
| WO | WO 2019108931 | 6/2019 |
| WO | WO 2019117857 | 6/2019 |
| WO | WO 2019147827 | 8/2019 |
| WO | WO 2019160859 | 8/2019 |
| WO | WO 2019161301 | 8/2019 |
| WO | WO 2019169067 | 9/2019 |
| WO | WO 2019236288 | 12/2019 |
| WO | WO 2019246263 | 12/2019 |
| WO | WO 2020006333 | 1/2020 |

OTHER PUBLICATIONS

U.S. Appl. No. 16/708,834, filed Dec. 10, 2019, Li et al.
U.S. Appl. No. 16/708,865, filed Dec. 10, 2019, Li et al.
U.S. Appl. No. 16/708,872, filed Dec. 10, 2019, Li et al.
U.S. Appl. No. 16/831,426, filed Mar. 26, 2020, Li et al.
U.S. Appl. No. 16/831,483, filed Mar. 26, 2020, Li et al.
U.S. Appl. No. 16/831,559, filed Mar. 26, 2020, Li et al.
U.S. Appl. No. 16/897,794, filed Jun. 10, 2020, Li et al.
U.S. Appl. No. 16/897,801, filed Jun. 10, 2020, Li et al.
U.S. Appl. No. 16/897,805, filed Jun. 10, 2020, Li et al.
U.S. Appl. No. 17/010,628, filed Sep. 2, 2020, Sehsah et al.
U.S. Appl. No. 17/336,637, filed Jun. 2, 2021, Zhan et al.
U.S. Appl. No. 63/031,077, filed May 28, 2020, Zhan et al.
U.S. Appl. No. 63/033,669, filed Jun. 2, 2020, Zhan et al.
PCT International Search Report and Written Opinion in International Appln. No. PCT/US2021/048912, dated Dec. 3, 2021, 15 pages.
"IADC Dull Grading for PDC Drill Bits," Beste Bit, SPE/IADC 23939, 1992, 52 pages.
AkerSolutions, "Aker MH CCTC Improving Safety," AkerSolutions, Jan. 2008, 12 pages.
Anwar et al., "Fog computing: an overview of big IoT data analytics," ID 7157192, Wiley, Hindawi, Wireless communications and mobile computing, May 2018, 2018: 1-22, 23 pages.
Artymiuk et al., "The new drilling control and monitoring system," Acta Montanistica Slovaca, Sep. 2004, 9:3 (145-151), 7 pages.
Ashby et al., "Coiled Tubing Conveyed Video Camera and Multi-Arm Caliper Liner Damage Diagnostics Post Plug and Perf Frac," SPE-172622-MS, Society of Petroleum Engineers (SPE), presented at the SPE Middle East Oil & Gas Show and Conference, Mar. 8-11, 2015, 12 pages.
Bilal et al., "Potentials, trends, and prospects in edge technologies: Fog, cloudlet, mobile edge, and micro data centers," Computer Networks, Elsevier, Oct. 2017, 130: 94-120, 27 pages.
buyrov.com [online], "Charpie: The best ROV manufacturer," available on or before 2017, retrieved on Jun. 27, 2019, retrieved from URL <www.buyrov.com/>, 5 pages.
Carpenter, "Advancing Deepwater Kick Detection," JPT, 68:5, May 2016, 2 pages.
Caryotakis, "The klystron: A microwave source of surprising range and endurance." The American Physical Society, Division of Plasma Physics Conference in Pittsburg, PA, Nov. 1997, 14 pages.
Commer et al., "New advances in three-dimensional controlled-source electromagnetic inversion," Geophys. J. Int, 2008, 172: 513-535, 23 pages.
Corona et al., "Novel Washpipe-Free ICD Completion With Dissolvable Material," OTC-28863-MS, presented at the Offshore Technology Conference, Houston, TX, Apr. 30-May 3, 2018, 2018, OTC, 10 pages.
Decker et al., "Opportunities for Waste Heat Recovery at Contingency Bases," Construction Engineering Research Laboratory (CERL), US Army Corps of Engineers, ERDC, Apr. 2016, 61 pages.
Dickens et al., "An LED array-based light induced fluorescence sensor for real-time process and field monitoring," Sensors and Actuators B: Chemical, Elsevier, Apr. 2011, 158:1 (35-42), 8 pages.
Dong et al., "Dual Substitution and Spark Plasma Sintering to Improve Ionic Conductivity of Garnet Li7La3Zr2O12," Nanomaterials, 9:721, 2019, 10 pages.
downholediagnostic.com [online] "Acoustic Fluid Level Surveys," retrieved from URL <https://www.downholediagnostic.com/fluid-level> retrieved on Mar. 27, 2020, available on or before 2018, 13 pages.
edition.cnn.com [online], "Revolutionary gel is five times stronger than steel," retrieved from URL <https://edition.cnn.com/style/article/hydrogel-steel-japan/index.html>, retrieved on Apr. 2, 2020, available on or before Jul. 16, 2017, 6 pages.
engineersedge.com [online], "Engineers Edge—ACME Stub Threads Size Designation Table Chart," retrieved from URL <http://www.engineersedge.com/hardware/acme-stub-thread.htm>, retrieved Feb. 27, 2017, 2 pages.
exploration.marinersmuseum.org [online], "ROV", available on or before May 2019, retrieved on Jun. 27, 2019, retrieved from URL <https://exploration.marinersmuseum.org/object/rov/>, 3 pages.
Fjetland et al., "Kick Detection and Influx Size Estimation during Offshore Drilling Operations using Deep Learning," INSPEC 18992956, IEEE, presented at the 2019 14th IEEE Conference on Industrial Electronics and Applications (ICIEA), Jun. 19-21, 2019, 6 pages.
Gemmeke and Ruiter, "3D ultrasound computer tomography for medical imagining," Nuclear Instruments and Methods in Physics Research Section A:580 (1057-1065), Oct. 1, 2007, 9 pages.
gryphonoilfield.com [online], "Gryphon Oilfield Services, Echo Dissolvable Fracturing Plug," available on or before Jun. 17, 2020,

(56) References Cited

OTHER PUBLICATIONS retrieved on Aug. 20, 2020, retrieved from URL <https://www.gryphonoilfield.com/wp-content/uploads/2018/09/Echo-Series-Dissolvable-Fracturing-Plugs-8-23-2018-1.pdf>, 1 page.
Guilherme et al., "Petroleum well drilling monitoring through cutting image analysis and artificial intelligence techniques," Engineering Applications of Artificial Intelligence, Feb. 2011, 201-207, 7 pages.
halliburton.com [online], "Drill Bits and Services Solutions Catalogs," retrieved from URL: <https://www.halliburton.com/content/dam/ps/public/sdbs/sdbs_contents/Books_and_Catalogs/web/DBS-Solution.pdf> on Sep. 26, 2019, 2014, 64 pages.
Hegde et al., "Application of Real-time Video Streaming and Analytics to Breakdown Rig Connection Process," OTC-28742-MS, presented at the Offshore Technology Conference, Houston, Texas, USA, Apr. 2018, 14 pages.
Hopkin, "Factor Affecting Cuttings Removal during Rotary Drilling," Journal of Petroleum Technology 19.06, Jun. 1967, 8 pages.
Ji et al., "Submicron Sized Nb Doped Lithium Garnet for High Ionic Conductivity Solid Electrolyte and Performance of All Solid-State Lithium Battery," doi:10.20944/preprints201912.0307.v1, Dec. 2019, 10 pages.
Johnson et al., "Advanced Deepwater Kick Detection," IADC/SPE 167990, presented at the 2014 IADC/SPE Drilling Conference and Exhibition, Mar. 4-6, 2014, 10 pages.
Johnson, "Design and Testing of a Laboratory Ultrasonic Data Acquisition System for Tomography" Thesis for the degree of Master of Science in Mining and Minerals Engineering, Virginia Polytechnic Institute and State University, Dec. 2, 2004, 108 pages.
King et al., "Atomic layer deposition of TiO2 films on particles in a fluidized bed reactor," Power Technology, 183:3, Apr. 2008, 8 pages.
Koulidis et al., "Field assessment of camera based drilling dynamics," presented at the SPE Middle East Oil & Gas Show and Conference, Manama, Bahrain, Nov.-Dec. 2021, 11 pages.
Lafond et al., "Automated Influx and Loss Detection System Based on Advanced Mud Flow Modeling," SPE-195835-MS, Society of Petroleum Engineers (SPE), presented at the SPE Annual Technical Conference and Exhibition, Sep. 30-Oct. 2, 2019, 11 pages.
Li et al., 3D Printed Hybrid Electrodes for Lithium-ion Batteries, Missouri University of Science and Technology, Washington State University; ECS Transactions, 77 (11) 1209-1218 (2017), 11 pages.
Liu et al., "Flow visualization and measurement in flow field of a torque converter," Mechanic automation and control Engineering, Second International Conference on IEEE, Jul. 15, 2011, 1329-1331.
Liu et al., "Hardness of Polycrystalline Wurtsite Boron Nitride (wBN) Compacts," Scientific Reports, Jul. 2019, 9(1): 1-6, 6 pages.
Liu et al., "Superstrong micro-grained polycrystalline diamond compact through work hardening under high pressure," Appl. Phys. Lett. Feb. 2018, 112: 6 pages.
Luo et al., "Simple Charts to Determine Hole Cleaning Requirements in Deviated Wells," IADC/SPE 27486, SPE/IADC Drilling Conference, Society of Petroleum Engineers, Feb. 15-18, 1994, 7 pages.
Magana-more et al., "Well control space out: a deep learning approach for the optimization of drilling safety operations," IEEE Access, 2021, 9, 14 pages.
Maurer, "The Perfect Cleaning Theory of Rotary Drilling," Journal of Petroleum Technology 14.11, 1962, 5 pages.
Mehrad et al., "Developing a new rigorous drilling rate prediction model using a machine learning technique," Journal of Petroleum Science and Engineering, Sep. 2020, 192, 27 pages.
nature.com [online], "Mechanical Behavior of a Soft Hydrogel Reinforced with Three-Dimensional Printed Microfibre Scaffolds," retrieved from URL <https://www.nature.com/articles/s41598-018-19502-y>, retrieved on Apr. 2, 2020, available on or before Jan. 19, 2018, 47 pages.
Nuth, "Smart oil field distributed computing," The Industrial Ethernet Book, Nov. 2014, 85:14 (1-3), 3 pages.
Offshore-mag.com [online], Offshore, "Completions Technology: Large monobore completions prevent high-volume gas well flow restrictions", Dec. 1, 2001, retrieved from URL <http://www.offshore-mag.com/articles/print/volume-61/issue-12/news/completions-technology-large-monobore-completions-prevent-high-volume-gas-well-flow-restrictions.html>, 9 pages.
Olver, "Compact Antenna Test Ranges," Seventh International Conference on Antennas and Propagation IEEE, Apr. 15-18, 1991, 10 pages.
Paiaman et al., "Effect of Drilling Fluid Properties on Rate Penetration," Nafta 60:3, 2009, 6 pages.
Parini et al., "Chapter 3: Antenna measurements," in Theory and Practice of Modem Antenna Range Measurements, IET editorial, 2014, 30 pages.
Pavkovic et al., "Oil drilling rig diesel power-plant fuel efficiency improvement potentials through rule-based generator scheduling and utilization of battery energy storage system," Energy Conversion and Management, Science Direct, May 2016, 121: 194-211, 18 pages.
petrowiki.org [online], "Hole Cleaning," retrieved from URL <http://petrowiki.org/Hole_cleaning#Annular-fluid_velocity>, retrieved on Jan. 25, 2019, 8 pages.
Petrowiki.org [online], "Kicks," Petrowiki, available on or before Jun. 26, 2015, retrieved on Jan. 24, 2018, retrieved from URL <https://petrowiki.org/Kicks>, 6 pages.
Phys.org [online], "Team develops underwater robot to assist in oil-spill cleanup," Phys Org, Mar. 16, 2015, 3 pages.
Ranjbar, "Cutting Transport in Inclined and Horizontal Wellbore," University of Stavanger, Faculty of Science and Technology, Master's Thesis, Jul. 6, 2010, 137 pages.
Rasi, "Hole Cleaning in Large, High-Angle Wellbores," IADC/SPE 27464, Society of Petroleum Engineers (SPE), presented at the 1994 SPE/IADC Drilling Conference, Feb. 15-18, 1994, 12 pages.
Rigzone.com [online], "How Do ROVs Work?" available on or before 1999, retrieved on Jun. 27, 2019, retrieved from URL <https://www.rigzone.com/training/insight.asp?insight_id=343&c_id=>, 5 pages.
rigzone.com [online], "How does Well Control Work?" Rigzone, available on or before 1999, retrieved on Jan. 24, 2019, retrieved from URL <https://www.rigzone.com/training/insight.asp?insight_id=304&c_id>, 5 pages.
Robinson and Morgan, "Effect of Hole Cleaning on Drilling Rate Performance," Paper Aade-04-Df-Ho-42, AADE 2004 Drilling Fluids Conference, Houston, Texas, Apr. 6-7, 2004, 7 pages.
Robinson, "Economic Consequences of Poor Solids and Control," AADE 2006 Fluids Conference and Houston, Texas, Apr. 11-12, 2006, 9 pages.
Rubaii et al., "A new robust approach for hole cleaning to improve rate of penetration," SPE 192223-MS, Society of Petroleum Engineers (SPE), presented at the SPE Kingdom of Saudi Arabia Annual Technical Symposium and Exhibition, Apr. 23-26, 2018, 40 pages.
Ruiter et al., "3D ultrasound computer tomography of the breast: A new era?" European Journal of Radiology 81S1, Sep. 2012, 2 pages.
sageoiltools.com [online] "Fluid Level & Dynamometer Instruments for Analysis due Optimization of Oil and Gas Wells," retrieved from URL <http://www.sageoiltools.com/>, retrieved on Mar. 27, 2020, available on or before 2019, 3 pages.
Schlumberger, "The Lifting Business," Offshore Engineer, Mar. 2017, 1 page.
Schlumberger, "Zeitecs Shuttle System Decreases ESP Replacement Time by 87%: Customer ESP riglessly retrieved in less than 2 days on coiled tubing," slb.com/zeitecs, 2015, 1 page.
Schlumberger, "Zeitecs Shuttle System Reduces Deferred Production Even Before ESP is Commissioned, Offshore Africa: Third Party ESP developed fault during installation and was retrieved on rods, enabling operator to continue running tubing without waiting on replacement," slb.com/zeitecs, 2016, 2 pages.
Schlumberger, "Zeitecs Shuttle: Rigless ESP replacement system," Brochure, 8 pages.
Schlumberger, "Zeitecs Shuttle: Rigless ESP replacement system," Schlumberger, 2017, 2 pages.

(56) References Cited

OTHER PUBLICATIONS

Sifferman et al., "Drilling cutting transport in full scale vertical annuli," Journal of Petroleum Technology 26.11, 48th Annual Fall Meeting of the Society of Petroleum Engineers of AIME, Las Vegas, Sep. 30-Oct. 3, 1973, 12 pages.
slb.com [online], "CERTIS: Retrievable, single-trip, production-level isolation system," retrieved from URL <www.slb.com/CERTIS>, 2017, 2 pages.
slb.com [online], "First Rigless ESP Retrieval and Replacement with Slickline, Offshore Congo: Zeitecs Shuttle System Eliminates Need to Mobilize a Workover Rig," retrieved from URL <slb.com/zeitecs>, 2016, 1 page.
slb.com [online], "Technical Paper: ESP Retrievable Technology: A Solution to Enhance ESP Production While Minimizing Costs," SPE 156189 presented in 2012, retrieved from URL <http://www.slb.com/resources/technical_papers/artificial_lift/156189.aspx>, retrieved on Nov. 2, 2018, 1 pages.
slb.com [online], "Zeitecs Shuttle Rigless ESP Replacement System," retrieved from URL <http://www.slb.com/services/production/artificial_lift/submersible/zeitecs-shuttle.aspx?t=3>, available on or before May 31, 2017, retrieved on Nov. 2, 2018, 3 pages.
slb.com [online], Mi Swaco: A Schlumberger Company, "Intelligent Fluids Monitoring System," available on or before Mar. 11, 2015, [retrieved May 1, 2018] retrieved from URL: <https://www.slb.com/resources/other_resources/brochures/miswaco/intelligent_fluids_monitoring_brochure.aspx>, 8 pages.
Sulzer Metco, "An Introduction to Thermal Spray," 4, 2013, 24 pages.
Takahashi et al., "Degradation study on materials for dissolvable frac plugs," URTeC 2901283, presented at the Unconventional Resources Technology Conference, Houston, Texas, Jul. 23-25, 2018, 9 pages.
tervesinc.com [online], "Tervalloy™ Degradable Magnesium Alloys," available on or before Jun. 12, 2016, via Internet Archive: Wayback Machine URL <https://web.archive.org/web/20160612114602/http://tervesinc.com/media/Terves_8-Pg_Brochure.pd>, retrieved on Aug. 20, 2020, <http://tervesinc.com/media/Terves_8-Pg_Brochure.pdf>, 8 pages.
Thefreedictionary.com [online], "Paddle", Jan. 2004, retrieved on Apr. 12, 2021, retrieved from URL <https://www.thefreedictionary.com/paddle>, 8 pages.
tiwoiltools.com [online], "Engineering Innovation Worldwide, TIW XPAK Liner Hanger System brochure," 2015 TIW Corporation, Houston TX, TIW0001D 06/15, retrieved from URL <http://www.tiwoiltools.com/Images/Interior/downloads/tiw_xpak_brochure.pdf>, 4 pages.
Tobenna, "Hole Cleaning Hydraulics," Universitetet o Stavanger, Faculty of Science and Technology, Master's Thesis, Jun. 15, 2010, 75 pages.
Utkin et al., "Shock Compressibility and Spallation Strength of Cubic Modification of Polycrystalline Boron Nitride," High Temperature, 2009, 47(5):628-634, 7 pages.
Wastu et al., "The effect of drilling mud on hole cleaning in oil and gas industry," Journal of Physics: Conference Series, Dec. 2019, 1402:2, 7 pages.
Weatherford, "RFID Advanced Reservoir Management System Optimizes Injection Well Design, Improves Reservoir Management," Weatherford.com, 2013, 2 pages.
Wei et al., "The Fabrication of All-Solid-State Lithium-Ion Batteries via Spark Plasma Sintering," Metals, 7: 372, 2017, 9 pages.
Wellbore Service Tools: Retrievable tools, "RTTS Packer," Halliburton: Completion Tools, 2017, 4 pages.
wikipedia.org [online], "Atomic layer deposition," available on or before Sep. 10, 2014, via Internet Archive: Wayback Machine URL <http://web.archive.org/web/20140910101023/http://en. wikipedia.org/wiki/Atomic_layer_deposition>, retrieved on Feb. 9, 2021, <https://en.wikipedia.org/wiki/Atomic_layer_deposition>.
wikipedia.org [online], "Chemical vapor deposition," available on or before Apr. 11, 2013, via Internet Archive: Wayback Machine URL <http://web.archive.org/web/20130411025512/http://en.wikipedia.org:80/wiki/Chemical_Vapor_Deposition>, retrieved on Feb. 9, 2021, URL <https://en.wikipedia.org/wiki/Chemical_vapor_deposition>, 12 pages.
wikipedia.org [online], "Optical Flowmeters," retrieved from URL <https://en.wikipedia.org/wiki/Flow_measurement#Optical_flowmeters>, retrieved on Mar. 27, 2020, available on or before Jan. 2020, 1 page.
Wikipedia.org [online], "Surface roughness," retrieved from URL <https://en.wikipedia.org/wiki/Surface_roughness>, retrieved on Apr. 2, 2020, available on or before Oct. 2017, 6 pages.
wikipedia.org [online], "Ultrasonic Flow Meter," retrieved from URL <https://en.wikipedia.org/wiki/Ultrasonic_flow_meter>, retrieved on Mar. 27, 2020, available on or before Sep. 2019, 3 pages.
Williams and Bruce, "Carrying Capacity of Drilling Muds," Journal of Petroleum Technology, 3.04, 192, 1951, 10 pages.
Xia et al., "A Cutting Concentration Model of a Vertical Wellbore Annulus in Deep-water Drilling Operation and its Application," Applied Mechanics and Materials, 101-102, Sep. 27, 2011, 5 pages.
Xue et al., "Spark plasma sintering plus heat-treatment of Ta-doped Li7La3Zr2O12 solid electrolyte and its ionic conductivity," Mater. Res. Express 7 (2020) 025518, 8 pages.
Zhan et al. "Effect of β-to-α Phase Transformation on the Microstructural Development and Mechanical Properties of Fine-Grained Silicon Carbide Ceramics," Journal of the American Ceramic Society 84.5, May 2001, 6 pages.
Zhan et al. "Single-wall carbon nanotubes as attractive toughening agents in alumina-based nanocomposites," Nature Materials 2,1, Jan. 2003, 6 pages.
Zhan et al., "Atomic Layer Deposition on Bulk Quantities of Surfactant Modified Single-Walled Carbon Nanotubes," Journal of American Ceramic Society, 91:3, Mar. 2008, 5 pages.
Zhang et al., "Increasing Polypropylene High Temperature Stability by Blending Polypropylene-Bonded Hindered Phenol Antioxidant," Macromolecules, 51:5 (1927-1936), 2018, 10 pages.
Zhu et al., "Spark Plasma Sintering of Lithium Aluminum Germanium Phosphate Solid Electrolyte and its Electrochemical Properties," University of British Columbia; Nanomaterials, 9, 1086, 2019, 10 pages.

* cited by examiner

CUTTING PIPES IN WELLBORES USING DOWNHOLE AUTONOMOUS JET CUTTING TOOLS

TECHNICAL FIELD

The present disclosure generally relates to cutting tools and operations for use in a wellbore, more particularly downhole autonomous jet cutting tools and methods that can be used to locate and cut a stuck pipe in a wellbore.

BACKGROUND

Drill pipes may be employed to drill oil and gas wellbores. Collectively, when connected, they form one entity called the drill string. In some instances, the drill string may get "stuck" in the wellbore due to the shape of the hole, accumulation of cuttings, or differential pressure. In such an event, the drilling crew is unable to move the drill string down to continue drilling or pull the string out-of-hole.

Mechanical and hydraulic tools are used to free the drill string from the wellbore. Using chemicals (for example, acids), or simply cutting of the drill string, pulling the freed part out of the hole, and continuing drilling "side-track" within the wellbore are ways to resolve the issue. Mechanical and hydraulic tools can be run downhole on a wire-line and typically rely on prior knowledge of the location of the "stuck" drill string.

SUMMARY

This specification describes downhole autonomous jet cutting tools and methods that can be used to locate and cut a stuck pipe in a wellbore. These tools are not supported from the surface and do not require prior knowledge of the "stuck" pipe location.

The tools and methods described in this specification provide an approach in which the downhole autonomous jet cutting tool is dropped or pumped down in a pipe (for example, a drill pipe or a casing string) to reach the location of the "stuck" pipe and to perform pipe cutting without being supported from the surface (for example, on a wire-line). This downhole autonomous jet cutting tool includes a sensor module. In operation, the jet cutting tool is dropped into drill pipe and moves downhole with fluid being pumped downhole. Once the sensor module detects the "stuck" location of the pipe, the jet cutting tool anchors itself near the "stuck" location and starts cutting the stuck pipe.

The jet cutting tool also includes a body with a hydraulic motor, a locking unit, a jet cutting nozzle assembly, and a control unit. The hydraulic motor includes a rotor embedded inside a stator. Rubber baffles extend radially outward from the body to limit flow around the body. The locking unit extends from an uphole end of the hydraulic motor and includes slips or a packer element. The terms "uphole end" and "downhole end" are used to indicate the end of a component that would be uphole or downhole when a component is deployed in a wellbore rather indicating an absolute direction. The slips (or the packer element) are used to anchor the body in place and prevent motion and rotation.

The jet cutting nozzle assembly extends on the downhole end of the hydraulic motor and is attached to the rotor part of the hydraulic motor. The jet cutting nozzle assembly includes a nozzle from which a stream of fluid is emitted to cut the "stuck" pipe.

In use, the jet cutting tool is dropped downhole in a drill pipe and can travel towards the bottom hole assembly (BHA). The sensor module can include sensors, instrumentation and signal processing circuits, receivers, transmitters, connecting probes, and data storing and processing devices.

Certain aspects of the subject matter herein can be implemented as a downhole autonomous jet cutting tool configured to cut a pipe in a wellbore. The tool includes a main body that has a generally cylindrical configuration such that the main body limits a downhole flow of fluids past the tool when the tool is deployed in the pipe. The main body includes a locking unit actuable to engage the tool to the inner surface of the pipe, a hydraulic motor including a rotor and a stator, and a jet cutting nozzle assembly rotatable by the rotor and operable to emit a stream of fluid to cut the pipe. The tool also includes a sensor module operable to detect interactions between the pipe and walls of the wellbore, and a control unit in electronic communication with the sensor module, the locking unit, and the actuation unit. The control unit is configured to identify a location where interaction between the pipe and the walls of the wellbore limits downhole movement of the pipe based on output of the sensor module, actuate the locking unit to engage the tool in the inner surface of the pipe, and initiate the stream of fluid from the jet cutting nozzle assembly.

An aspect combinable with any of the other aspects can include the following features. The locking unit can include a packer.

An aspect combinable with any of the other aspects can include the following features. The locking unit can include slips.

An aspect combinable with any of the other aspects can include the following features. The sensor module can include an acoustic transmitter oriented to send an acoustic signal radially outward relative to an axis of the tool.

An aspect combinable with any of the other aspects can include the following features. The acoustic signal can have a frequency of 20-30 kHz.

An aspect combinable with any of the other aspects can include the following features. The sensor module can include an acoustic receiver and the control unit can be configured to identify the location where interaction between the pipe and the walls of the wellbore limits downhole movement of the pipe based on output of the sensor by a change in attenuation of the acoustic signal.

An aspect combinable with any of the other aspects can include the following features. The sensor module can include an electromagnetic transmitter oriented to generate magnetic field radially outward relative to an axis of the tool.

An aspect combinable with any of the other aspects can include the following features. The sensor module can include an electromagnetic receiver and the control unit can be configured to identify the location where interaction between the pipe and the walls of the wellbore limits downhole movement of the pipe based on a difference between sensor outputs.

An aspect combinable with any of the other aspects can include the following features. The sensor module can include an ultrasonic sensor.

An aspect combinable with any of the other aspects can include the following features. The hydraulic motor can include a rotor embedded inside a stator and the jet cutting nozzle assembly can be rotationally fixed to the rotor.

An aspect combinable with any of the other aspects can include the following features. The body can include rubber baffles extending radially outward.

An aspect combinable with any of the other aspects can include the following features. Initiating the stream of fluid from the jet cutting nozzle assembly can include opening a valve in the main body to permit drilling fluid to enter the main body and exit the jet cutting nozzle assembly.

An aspect combinable with any of the other aspects can include the following features. The rotor can rotate in response to the drilling fluid flowing through the main body.

Certain aspects of the subject matter herein can be implemented as a downhole autonomous jet cutting tool configured to cut a pipe in a wellbore. The tool includes a body that includes a hydraulic motor with a rotor embedded inside a stator and a locking unit attached to the body. The locking unit is actuable to engage the tool in the inner surface of the pipe. The tool also includes a sensor module operable to detect interactions between the pipe and walls of the wellbore, and a jet cutting nozzle assembly operable to emit a stream of fluid to cut the pipe and to rotate in response to rotation of the rotor.

An aspect combinable with any of the other aspects can include the following features. The autonomous jet cutting tool can include a control unit in electronic communication with the sensor module, the locking unit, and a main valve. The control unit can be configured to identify a location where interaction between the pipe and the walls of the wellbore limits a downhole movement of the pipe based on output of the sensor module, actuate the locking unit to engage the tool to the inner surface of the pipe, and open a valve to allow a flow of fluid through the hydraulic motor and through a cutting nozzle of the jet cutting nozzle assembly. The flow of fluid can rotate the rotor and the jet cutting nozzle assembly.

An aspect combinable with any of the other aspects can include the following features. The locking unit can include a packer.

An aspect combinable with any of the other aspects can include the following features. The locking unit can include slips.

An aspect combinable with any of the other aspects can include the following features. The sensor module can include an acoustic transmitter oriented to send an acoustic signal radially outward relative to an axis of the tool.

An aspect combinable with any of the other aspects can include the following features. The body further comprises rubber baffles extending radially outward.

An aspect combinable with any of the other aspects can include the following features. The downhole autonomous jet cutting tool of claim 15, wherein the pipe is a drill string and the fluid is drilling fluid.

Certain aspects of the subject matter herein can be implemented as a method for cutting a pipe in a wellbore. The method includes dropping a downhole autonomous jet cutting tool in a pipe. The tool can be controlled by a flow rate and be configured to identify a location where interaction between the pipe and walls of the wellbore limits a downhole movement of the pipe. The method also includes sensing the pipe with a sensor module until it reaches the location where interaction between the pipe and the walls of the wellbore limits a downhole movement of the pipe. A sensor module receives a signal from the sensor module with an identified location. A signal is sent to the tool to actuate a locking unit to lock the downhole autonomous jet cutting tool in a position proximate to the location where interaction between the pipe and the walls of the wellbore limits a downhole movement of the pipe, and to initiate a flow of fluid from a cutting nozzle of the tool to cut the pipe.

The downhole autonomous jet cutting tool can help to locate the "stuck pipe" point and cut the pipe in a single downhole trip. The downhole autonomous jet cutting tool operates without being supported from the surface (for example, on a wire-line). This approach simplifies the process of cutting of the drill string and pulling the freed part out of the hole during drilling reducing lost operation time and total cost. Pumping down the autonomous jet cutting tool without being supported from the surface also eliminates time associated with waiting for wire-line units to arrive and the cost associated with each wire-line unit. The downhole autonomous jet cutting tool saves tripping time and eliminates the need for prior knowledge of the "stuck pipe" location.

The downhole autonomous jet cutting tool design provides economic advantages by eliminating cost and time needed to mobilize, rig-up, and operate a wire-line unit. These factors can result in improved and efficient drilling operations and reduced operating time from approximately a week to less than a day.

The details of one or more embodiments of these systems and methods are set forth in the accompanying drawings and the description below. Other features, objects, and advantages of these systems and methods will be apparent from the description and drawings, and from the claims.

DETAILED DESCRIPTION

This specification describes downhole autonomous jet cutting tools and methods that can be used to locate and cut a stuck pipe in a wellbore. These tools are not supported from the surface and do not require prior knowledge of the "stuck" pipe location. The tools and methods described in this specification provide an approach in which the downhole autonomous jet cutting tool is dropped or pumped down in a drill pipe to reach the location of the "stuck" pipe and to perform pipe cutting without being supported from the surface (for example, on a wire-line). This downhole autonomous jet cutting tool includes a body and a sensor module. In operation, the jet cutting tool is dropped into drill pipe and moves downhole with fluid being pumped downhole. Once the sensor module detects the "stuck" location of the pipe, the cutting tool anchors itself near the "stuck" location and starts cutting the stuck pipe.

Figure 1:
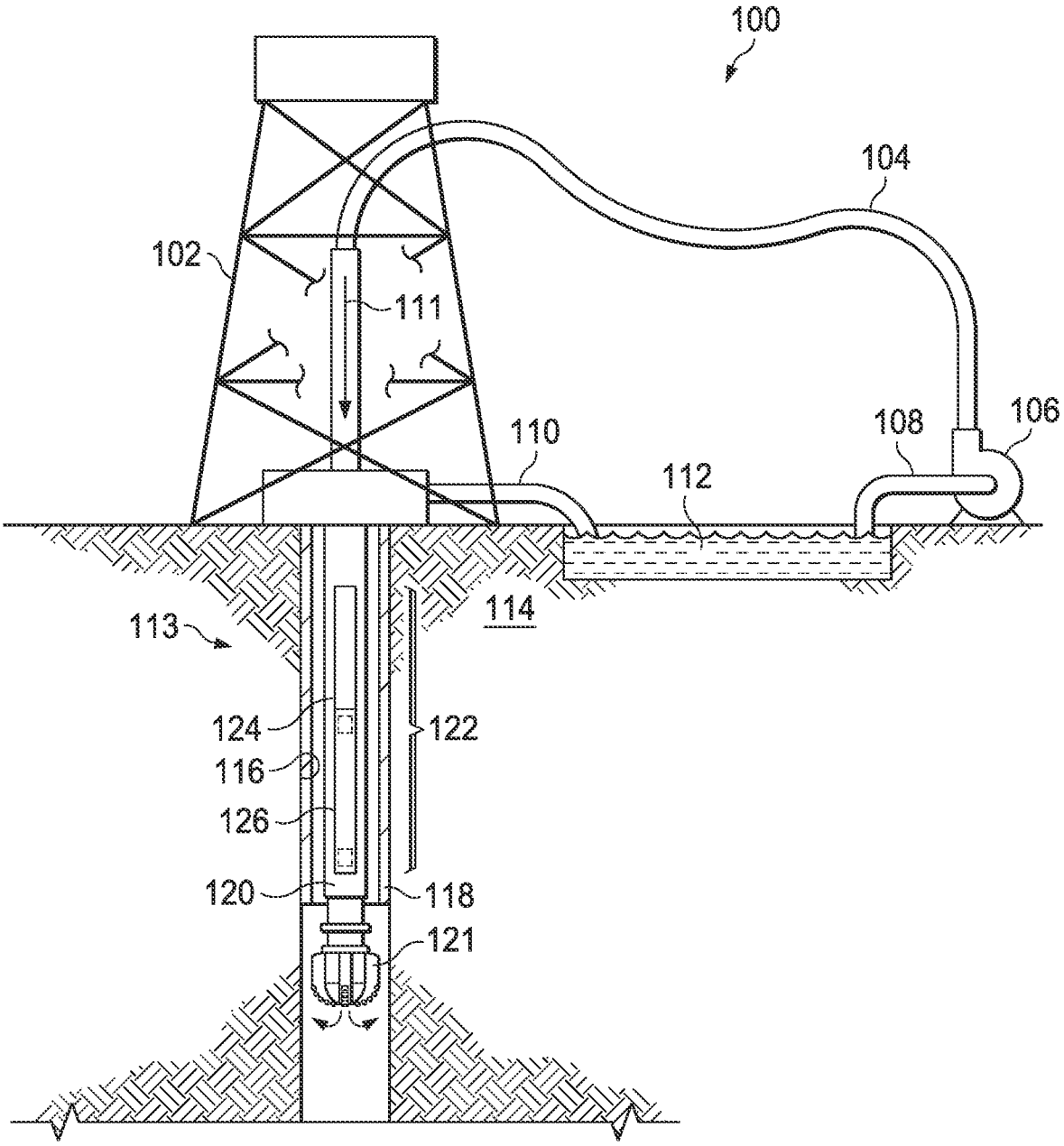
FIG. 1 is a schematic view of a drilling system including a downhole autonomous jet cutting tool.

FIG. 1 is a schematic view of a drilling system 100. The drilling system 100 includes a derrick 102 that supports a downhole portion 113 of the drilling system 100. The downhole portion 113 of drilling system 100 includes a drill string 120 formed of multiple connected drill pipes and a drill bit 121 attached at the downhole end of drill string 120. The drilling system 100 is shown being used to drill a wellbore 116 into a subsurface formation 114. The wellbore 116 is illustrated as having a casing 118 but not all wellbores are cased.

A drilling fluid 111 (sometimes referred to as drilling mud) is pumped down the drill string 120 and returns up an annulus between the drill string 120 and walls of the wellbore 116. A circulation pump 106 draws drilling fluid 111 from a mud pit 112 and pumps the drilling fluid 111 into the drill string 120. Conduits 104, 108, and 110 provide hydraulic connections between the circulation pump 106 and the drill string 120, between the wellbore 116 and the mud pit 112, and between the mud pit 112 and the circulation pump 106. The conduits can include hose, pipe, open channels, filters, or combinations of these components capable of handling the desired pressures and flowrates.

Figure 3A:
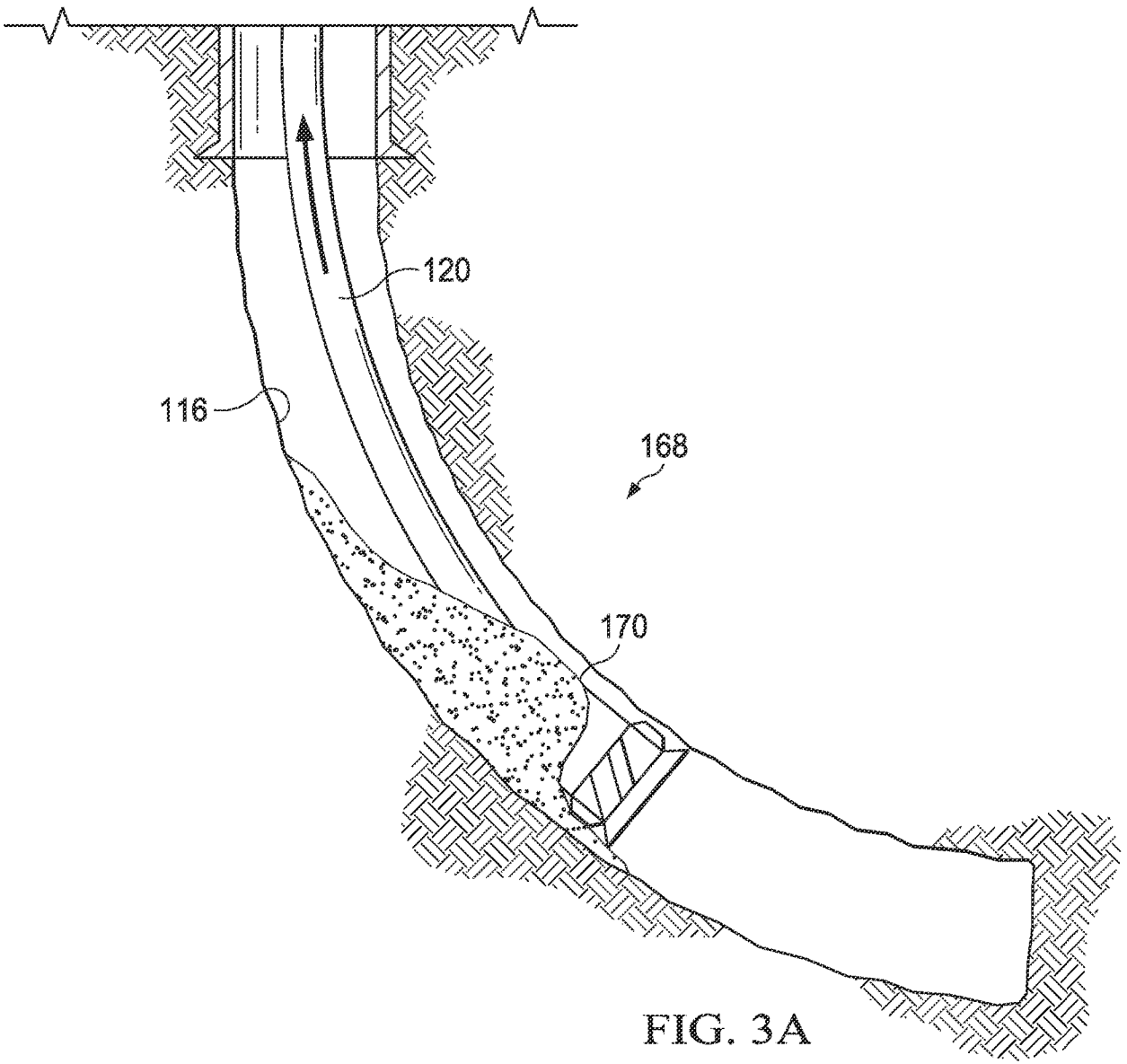
FIGS. 3A-3C are schematic views of different scenarios for a stuck pipe incident.
Figure 3B:
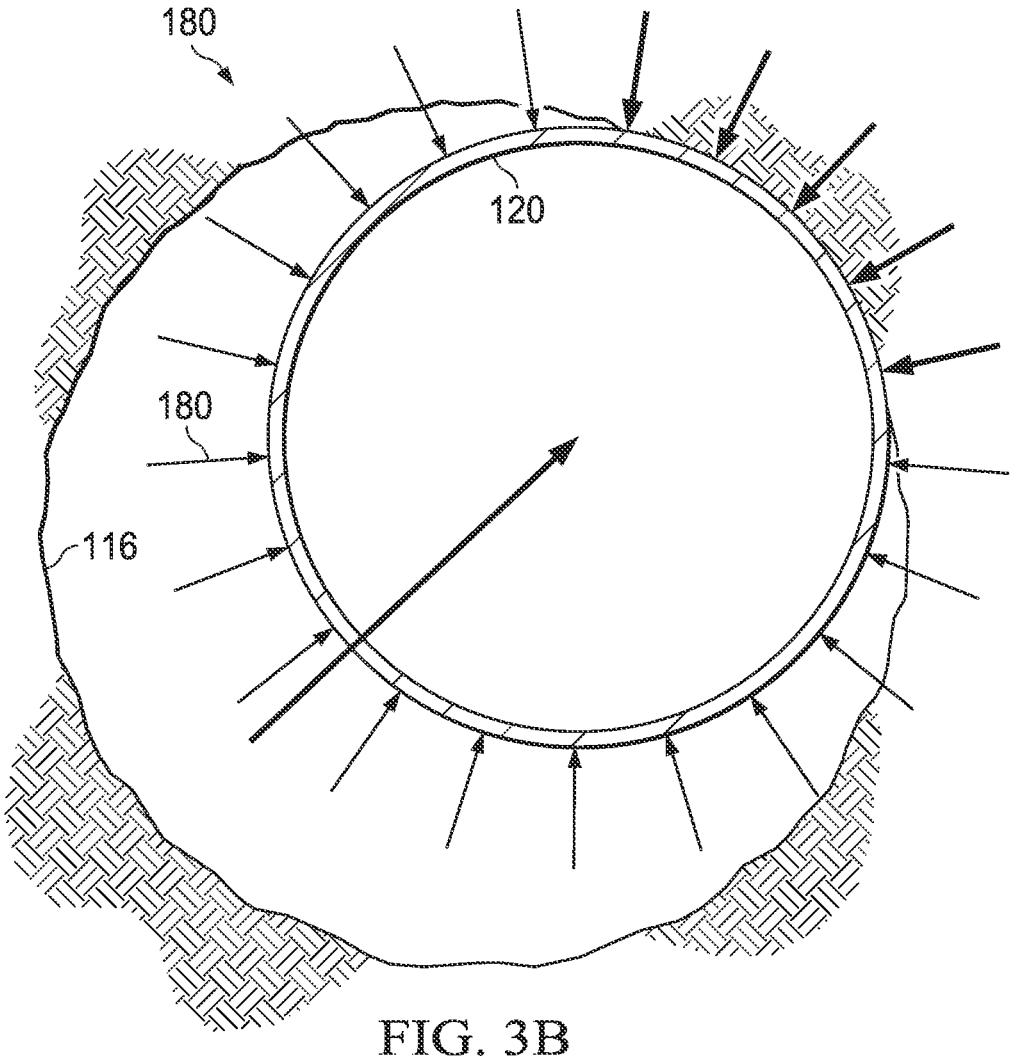

Sometimes during drilling, the drill string 120 gets stuck, for example, due to an accumulation of cuttings, due to differential pressure between the drill string 120 and the wellbore 116, or due to the geometry of the wellbore 116. When a drill string 120 gets stuck, the drilling crew is unable to move the drill string down to continue drilling, nor can they pull the string out-of-hole. FIGS. 3A-3B, described in more detail below, illustrates the drill string 120 becoming stuck due to various different conditions.

Referring again to FIG. 1, a downhole autonomous jet cutting tool 122 is dropped into the drill string 120. As described in more detail below, downhole autonomous jet cutting tool 122 can detect a location where drill string 120 is stuck and cut drill string 120 at or near that location. The downhole autonomous jet cutting tool 122 can be an independent, autonomous unit that includes a main body 124 and a sensor module 126. In the illustrated tool, the main body 124 and the sensor module 126 are attached to each another with the sensor module 126 positioned at the downhole end of the main body 124. In some tools, the sensor module 126 is incorporated inside the main body 124 of tool 122. As illustrated, drilling fluid 111 being pumped down the drill string 120 pushes the downhole autonomous jet cutting tool 122 down drill string 120. In some embodiments, tool 122 can be propelled by wheels, a tractor, or other suitable conveyance method, in addition to or instead of being propelled by pumped fluid.

Figure 2A:
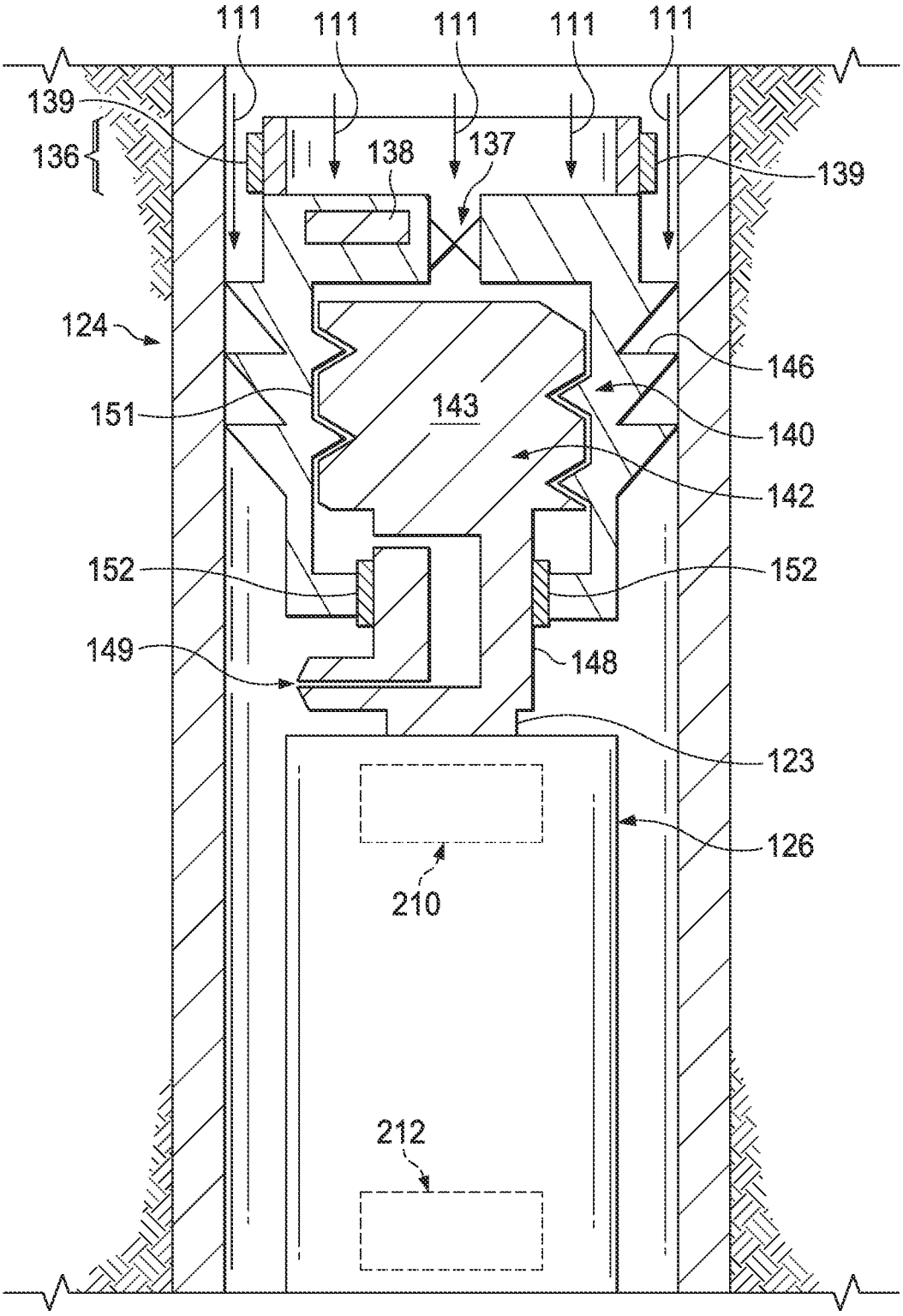
FIG. 2A is a schematic view of components in a downhole autonomous jet cutting tool.
Figure 2B:
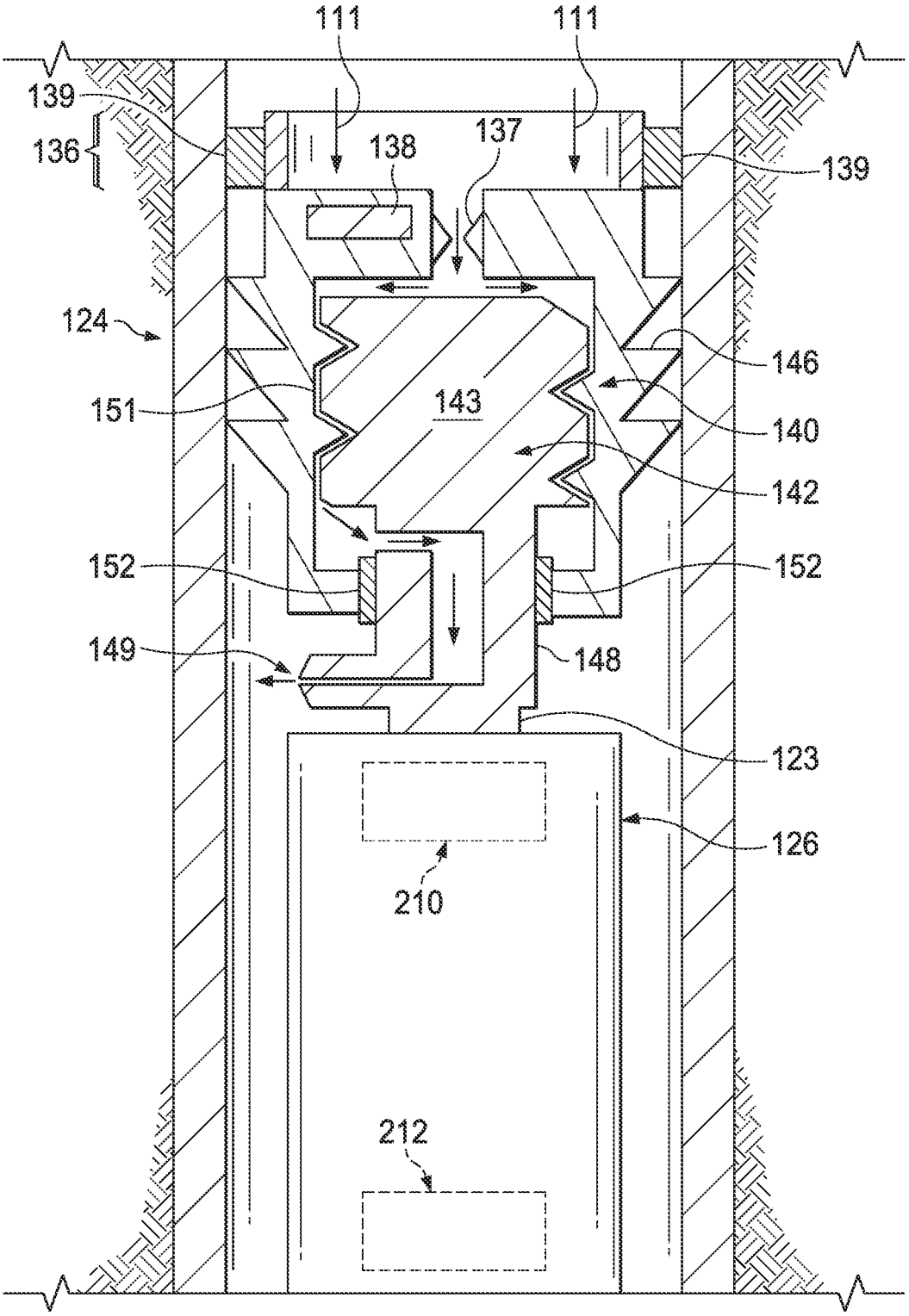
FIG. 2B is a schematic view of the jet cutting nozzle assembly of the autonomous jet cutting tool of FIG. 2A.

FIGS. 2A and 2B are schematic views of downhole autonomous jet cutting tool 122. In the illustrated embodiment, main body 124 and the sensor module 126 of tool 122 are mechanically attached to each other at a connection 123. For example, connection 123 can comprise a female downhole end of the main body 124 with internal threading receiving a male uphole end of the sensor module 126 with external threading. In some embodiments, connection 123 can be a temporary connection that allows sensor module 126 to disconnect from main body 124 after tool 122 has reached a suitable location downhole as determined based on sensor data from sensor module 126 (such that the function of sensor module 126 may no longer be required).

In the illustrated embodiments, main body 124 includes a locking unit 136, a main valve 137, a control unit 138, a hydraulic motor 143, and a jet cutting nozzle assembly 148. Locking unit 136 in the illustrated embodiment include grip elements 139 which can comprise packers or slips and which, when activated, grip the inner surface of drill string 120 so as to prevent the axial and rotational movement of main body 124 (but not prevent rotational movement of hydraulic motor 143 or jet cutting nozzle assembly 148). In some embodiments, grip elements 139 can include tapered elements that are forced against the inner surface of drill string 120 by releasing of pre-pressurized pistons.

Main valve 137 can be a solenoid-operated valve or other suitable valve. When open, and as described in more detail with respect to FIG. 2B, main valve 137 allows fluid (such as drilling fluid 111) to flow to hydraulic motor 143. Control unit 138 can be, can be a component of, or can be in wired or wireless communication with, a computer such as computer 1020 described in reference to FIG. 10. Control unit 138 can transmit commands to open or close main valve 137. As described in more detail below, control unit 138 can in some embodiments also send and receive other signals (such as sensor measurements from sensor module 126) to, for example, determine the location where drill string 120 is stuck or perform some or all of the other algorithms, computations, or calculations described herein.

Figure 10:
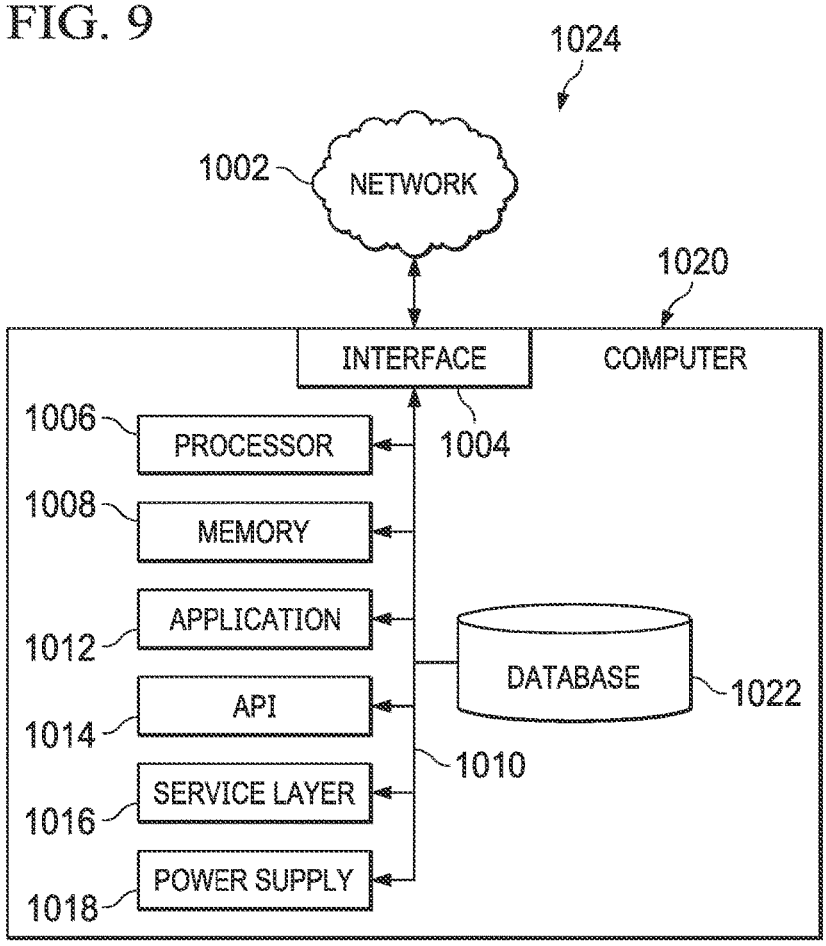
FIG. 10 is a block diagram of an example computer system.

Sensor module 126 can include transmitter 210, receiver 212, or other or additional sensors, instrumentation and signal processing circuits, connecting probes, and data storing and processing devices (such as some or all of the components described in reference to FIG. 10). As described in more detail below, sensor module 126 can generate, for example, magnetic fields or acoustic waves to determine a stuck point location of the drill string 120. In some embodiments, sensor module 126 can be or can comprise (for example) sensor module 500 of FIG. 5, sensor module 600 of FIGS. 6A and 6B, sensor module 700 of FIGS. 7A and 7B, or sensor module 800 of FIGS. 8A and 8B.

In the configuration shown in FIG. 2A, main valve 137 is closed and grip elements 139 are not activated. The size and generally cylindrical configuration of main body 124 limits the downhole flow of fluids past tool 122 between the tool and the inner surface of drill string 120, thus causing tool 122 to be carried downhole by the force of drilling fluid 111 being pumped through the drilling system 100. In some embodiments, main body 124 can also include external features that further limit the downhole flow of the pumping drilling fluid 111 past the autonomous jet cutting tool 122, thus increasing the force or speed at which the tool travels downhole. For example, in the illustrated embodiment, main body 124 includes rubber baffles 146 that extend radially outward that from the rest of the main body 124.

When tool 122 has reached a suitable location within drill string 120 (such as, for example, a location where drill string 120 is stuck, as described in more detail below), control unit 138 can transmit signals to activate grip elements 139 and open main valve 137, as shown in FIG. 2B. In the configuration shown in FIG. 2B, fluid (such as drilling fluid 111) can travel in a downhole direction into hydraulic motor 143. Hydraulic motor 143 can in some embodiments be a positive-displacement motor including a rotor 142 embedded inside a stator 140. Jet cutting nozzle assembly 148 is attached to and extends from the downhole end of rotor 142. In the illustrated embodiment, jet cutting nozzle assembly 148 and rotor 142 are a single piece. With main valve 137 open, drilling fluid 111 (or another suitable fluid) can flow through rotor-stator clearance 151, thus rotating rotor 142 and jet cutting nozzle assembly 148. Bearing seals 152 allow rotation of nozzle assembly 148 but prevent leakage of fluid. After the fluid leaves the rotor-stator clearance 151, it flows through ports into cutting nozzle 149. The force of the fluid from cutting nozzle 149 can cut through and sever drill string 120, thus freeing the upper portion of drill string 120 from the stuck portion and allowing the upper portion to be retrieved from the well. In some embodiments, jet cutting nozzle assembly 148 comprises a single cutting nozzle 149; in other embodiments, jet cutting nozzle assembly can comprise multiple nozzles (for example, two nozzles, or three nozzles, or four or more nozzles). In some embodiments, the flow rate through cutting nozzle 149 can be controlled by controlling the rate of fluid pumped by the surface circulation pump (such as pump 106 of FIG. 1).

Control unit 138 can be in wired or wireless communication with sensor module 126 such that control unit 138 can receive output from and send inputs to sensor module 126. As described in more detail below, output from the sensor module 126 may indicate the location where the drill string is stuck or the control unit 138 may interpret the output from the sensor module 126 to calculate and identify the location where the drill string is stuck. As previously discussed, where the drill string is stuck indicates a location where the interaction between the drill string 120 and walls of the wellbore 116 limits a movement of the drill string 120. A variety of events can impose limitations on the downhole movement of the drill string 120 at the contact interface between the drill string 120 and the wellbore 116.

Figure 3C:
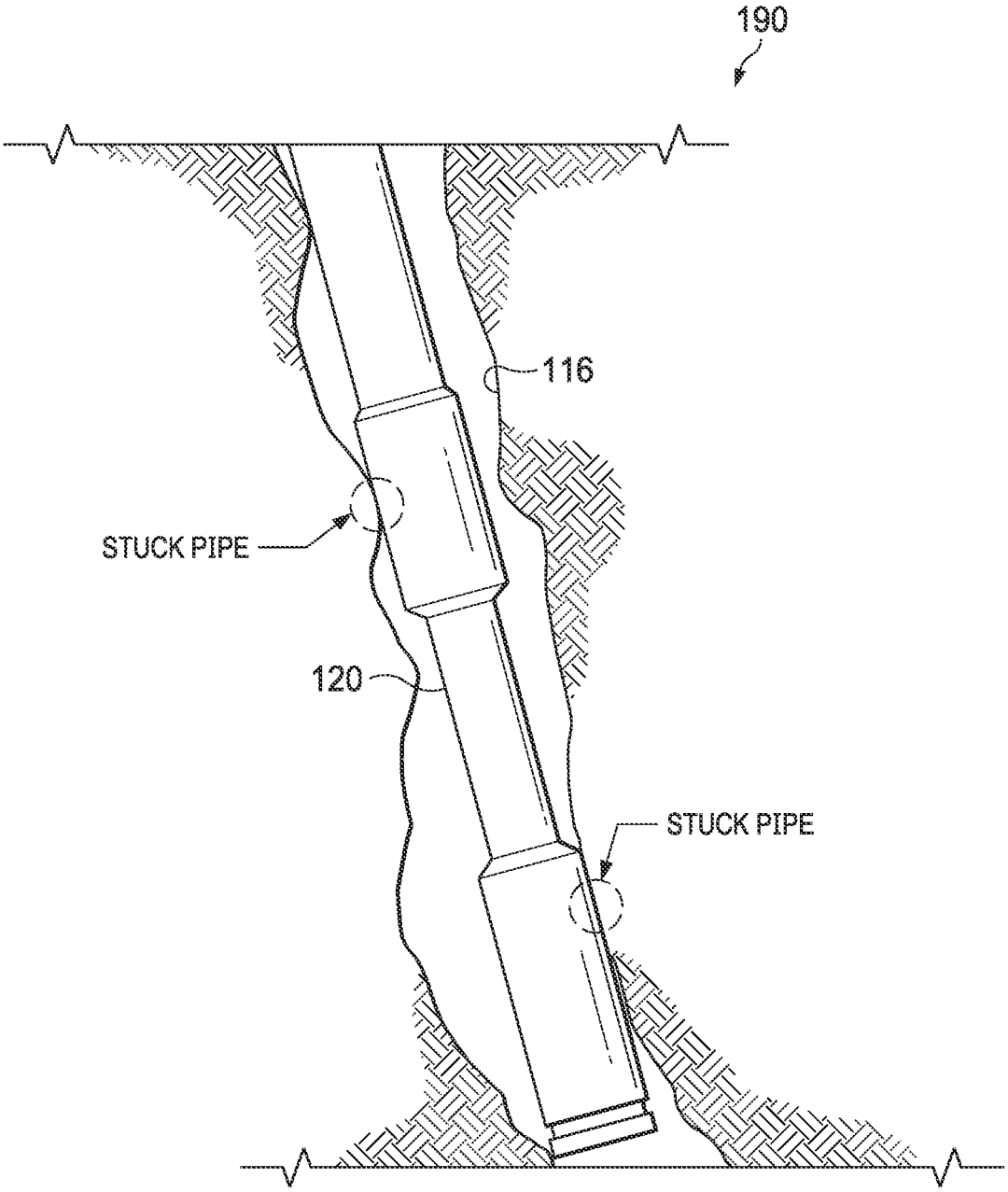

FIGS. 3A-3C are schematic views of different scenarios for a stuck pipe incident. FIG. 3A shows a drill string 120 stuck in wellbore 116 due to accumulation of cuttings 170. FIG. 3B shows a drill string 120 stuck due to differential pressure 180 between the drill string 120 and the wellbore 116. FIG. 3C shows a drill string 120 stuck due to the geometry of the wellbore 116. In these scenarios, the part of the drill pipe above the stuck point can be pulled up from the surface into a state of tension. The part of the drill pipe right below the stuck point is in a relaxed state. At the stuck point, a section of the drill string 120 makes contact with, and is held against, a wall of the wellbore. If a stuck pipe cannot be freed by other methods, the last option is to sever the pipe and perform a sidetrack to resume drilling the well. Prior to performing the sidetrack operation, the exact location and depth where the drill pipe is stuck is determined. The drill pipe is then severed at this point and a fishing operation is performed to recover the part of the drill string above the stuck point. The goal is to remove the string pipe at the greatest depth possible and, therefore, maintain the most of the depth of the well drilled and recover the most of the drill string.

Figure 4A:
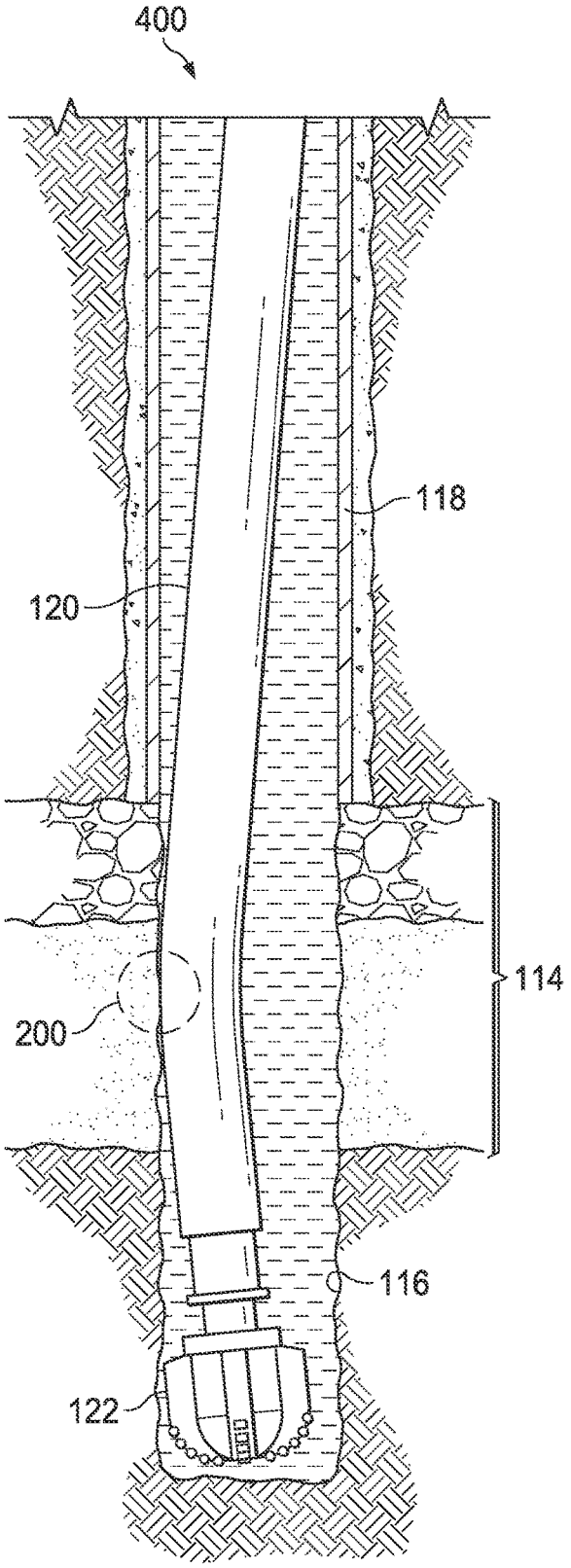
FIGS. 4A-4C are schematic views of a downhole autonomous jet cutting tool in various stages of operation.
Figure 4B:
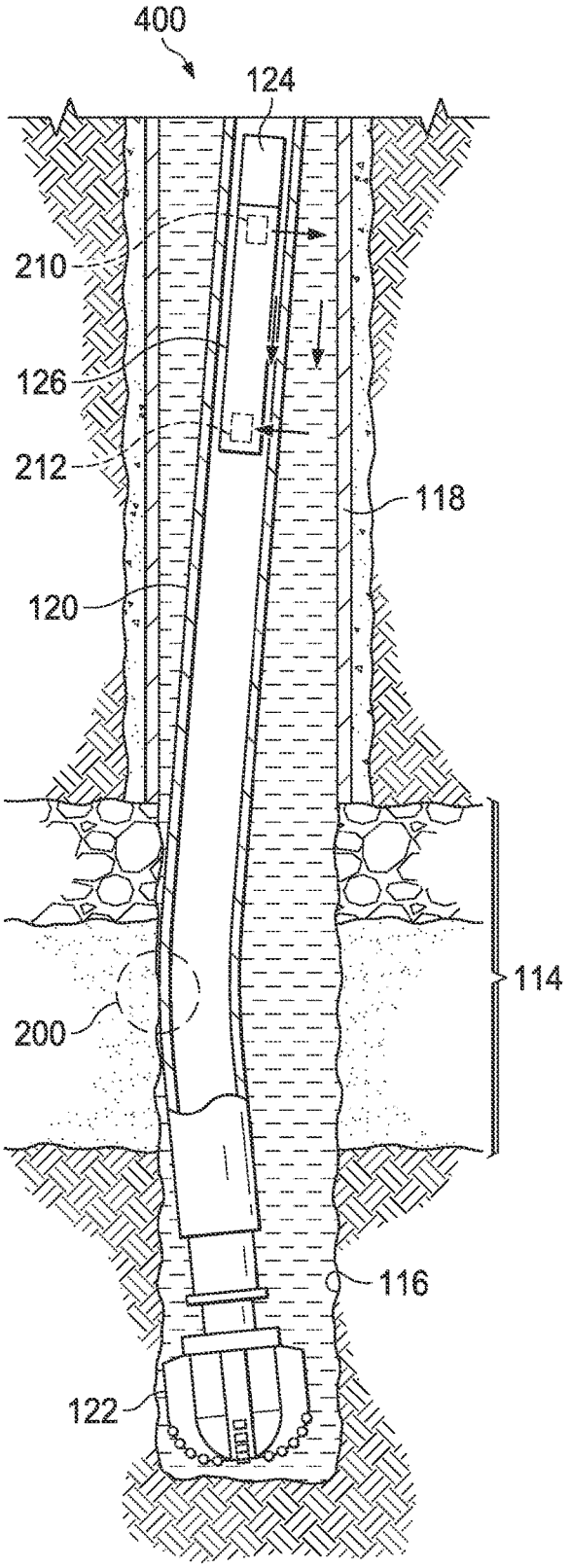
Figure 4C:
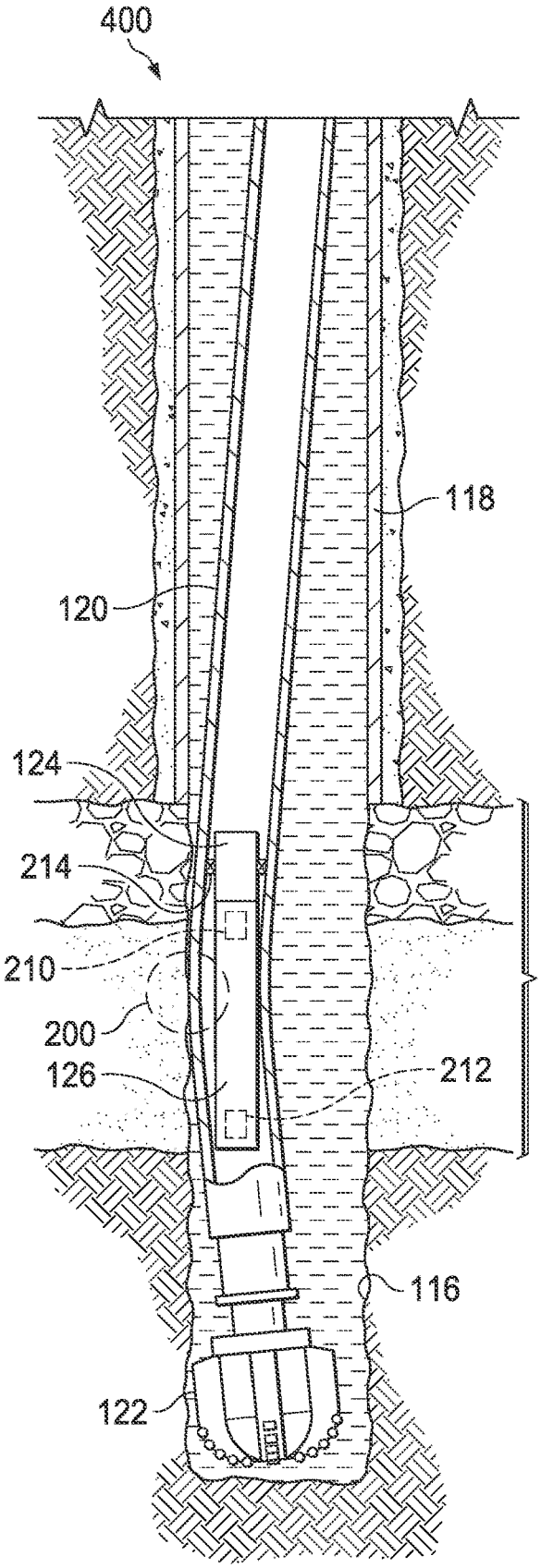

FIGS. 4A-4C are schematic views of a downhole autonomous jet cutting tool 122 in various stages of operation. The drill string 120 is illustrated as making contact with the wall of the wellbore 116 and getting stuck at a location 200 within subsurface formation 114. When the stuck pipe situation is identified, operators may try to free the drill string 120 by various methods. These include spotting acids, using jars, or applying cycles of high-force pick-ups and slack-offs. If unable to free the stuck pipe, the operators can drop the downhole autonomous jet cutting into the drill string 120 (see FIG. 4B). The downhole autonomous jet cutting tool 122 travels with the drilling fluid at a controlled speed down the drill string 120. The flow rate of the drilling fluid can control the travel speed of the downhole autonomous jet cutting tool 122. Although able to travel all the way to the bottom hole assembly (BHA), the cutting tool 122 is activated and fixed in position where the tool identifies the stuck pipe location using the sensor module 126. For example, the sensor module 126 can sense properties of the drill string 120 and the sensor module 126 or the control unit identify the stuck point location 200 by the transition between a portion of the drill string 120 in tension and a portion of the drill string 120 in a relaxed state, that is, wherein drill string 120 is only subject to its own weight. Once the stuck point 200 is located, the control unit 138 receives an output from the sensor module 126 and sends a signal to activate the grip elements 139 to engage with the inner surface of drill string 120 and open main valve 137 to allow drilling fluid to flow through the cutting tool 122 (as shown in FIG. 2B), thereby anchoring tool 122 in place. With main valve 137 opened, rotor 142 rotates with the nozzle assembly 148, and flow through the nozzle 149 can circumferentially cut and sever drill string 120.

Figure 5:
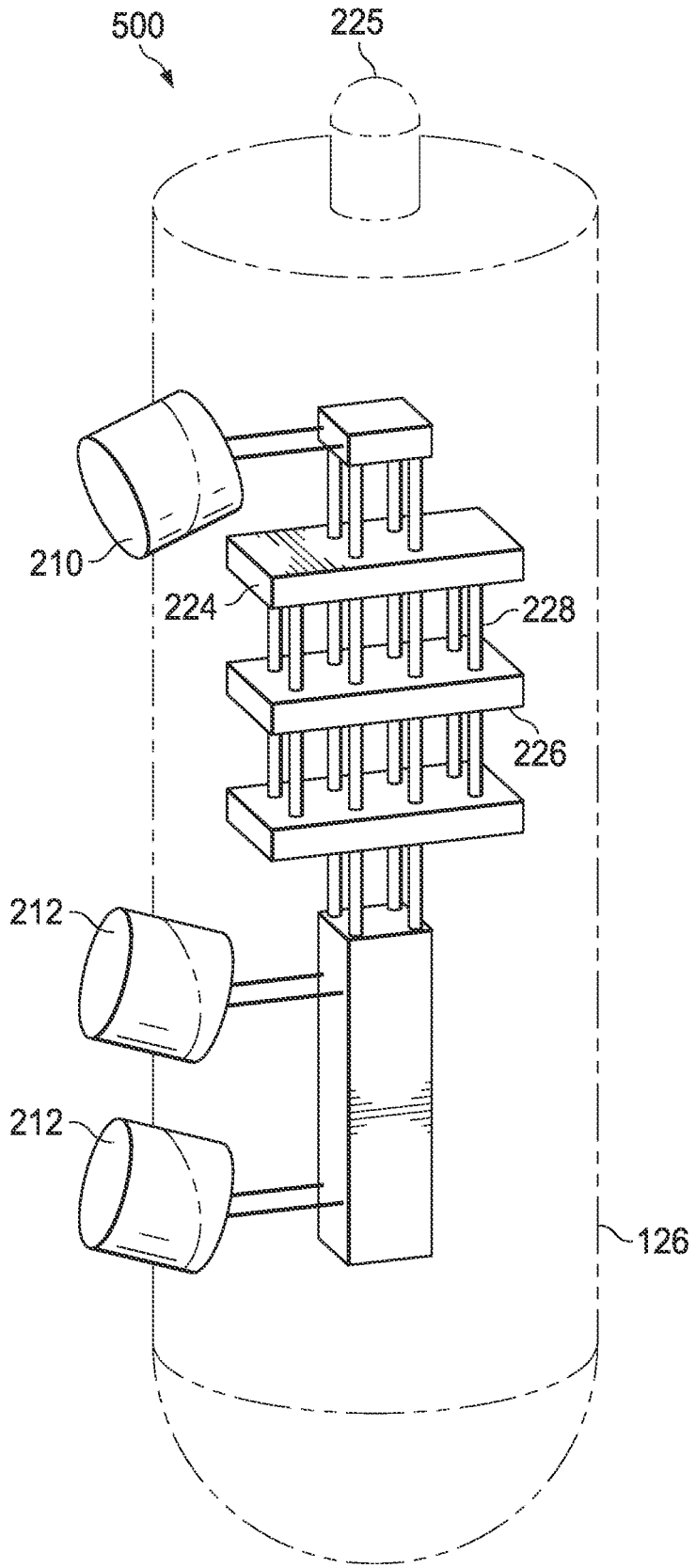
FIG. 5 is a schematic view of a downhole autonomous jet cutting tool with a sensor module configuration incorporating an acoustic sensor.

FIG. 5 is a schematic view of a downhole autonomous jet cutting tool 122 with a sensor module 500 incorporating an acoustic sensor. The sensor module 500 can include an acoustic transmitter 210, an acoustic receiver 212, sensor circuitry 224, a microcontroller 226, a connector probe 225 (for example, connector probes commercially available from Flow Control, Victrex, or Hermetic Solutions), and a plurality of through-chip vias 228. In some embodiments, the sensor module includes a micro-electromechanical system (MEMS) sensors and communication modules. The sensor module can include a three dimensional large-scale integration (3D-LSI) technology. This type of 3D integration can reduce the overall size of the sensor module and the cost of the overall tool. The smaller size technology enables a packing of a large number of sub modules such as sensors, microcontrollers, and communications in a compartment. The sensor circuitry 224 and microcontroller 226 can be stacked-type sub-modules and can be interconnected with short signal paths of through-chip vias 228 or through-silicon vias (TSVs). This configuration can also be aligned to eliminate vibration. The sensor module can include a protective cover to protect the sub modules from the harsh downhole environment. The protective cover can include chemical coatings (for example, polymers, epoxy, or resin-based materials) or material that can withstand continuous exposure to the harsh downhole environment.

The acoustic transmitter 210 can be oriented to send an acoustic signal radially outward relative to an axis of the tool 122. For example, the acoustic transmitter 210 of some sensor modules can emit an acoustic signal at a frequency between 20 and 30 kilohertz (kHz). The acoustic signal travels through a section of the drill string 120 or the casing 118 and the drilling fluid inside and outside the drill string 120 (see FIG. 4B). The acoustic wave can travel in an extensional or flexural mode, and the amplitude of the acoustic signal is measured at the acoustic receiver 212. The acoustic signal is then converted into attenuation by obtaining the ratio of amplitude between the transmitter 210 and the receiver 212. This change in attenuation of the acoustic signal allows the control unit 138 to identify the depth of the stuck location 200 where interaction between the string 120 and the walls of the wellbore 116 limits downhole movement of the string 120. In some examples, the sensor module 126 can include a plurality of receivers 212 spaced apart from the transmitter 210, and multiple transmitters 210 and receivers 212 around the sensor module 126. In some examples, the spacing between the transmitter and the receiver is between three and ten feet. Higher attenuation and lower signal amplitude can be an indication of a stuck pipe location where the drill pipe is in direct contact with the wellbore wall. At portions of the drill string 120 other than the stuck pipe location, the attenuation is typically lower and the signal amplitude is higher because the drill pipe is inside the wellbore but contacts the drilling fluid only. The acoustic sensor can include piezoelectric materials (for example, quartz, langasite, lithium niobate, titanium oxide, lead zirconate titanate, other materials exhibiting piezoelectricity, or combination thereof).

Figure 6A:
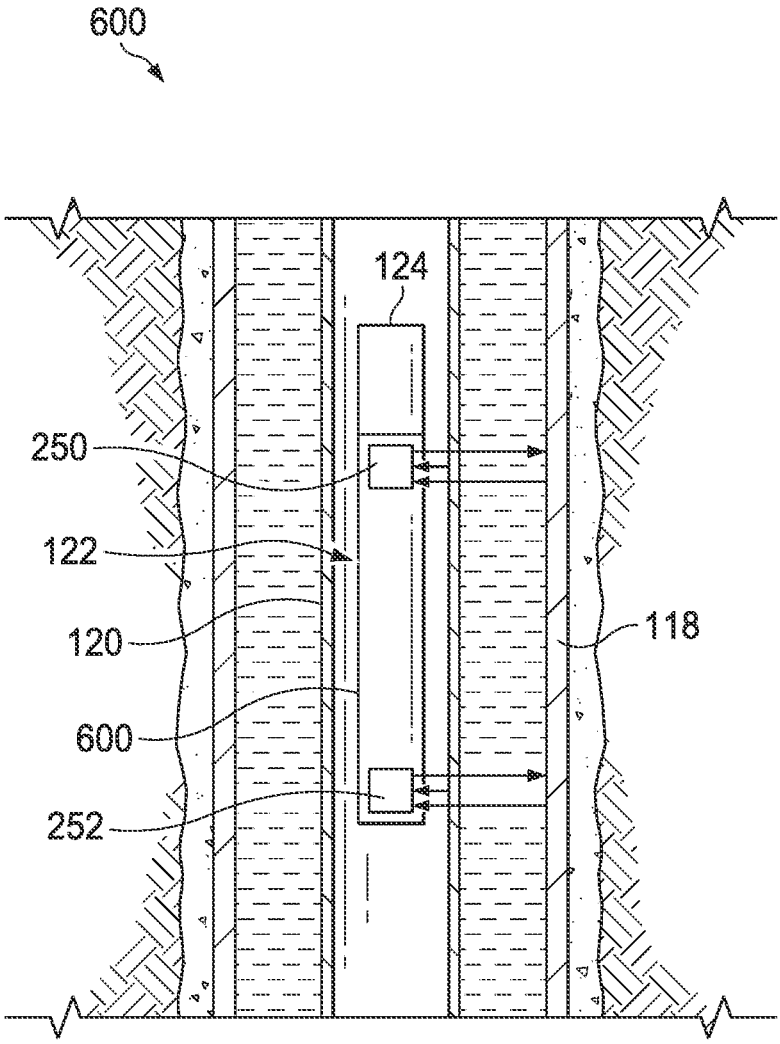
FIGS. 6A-6B are schematic views of a downhole autonomous jet cutting tool with a sensor module configuration incorporating an ultrasonic sensor.
Figure 6B:
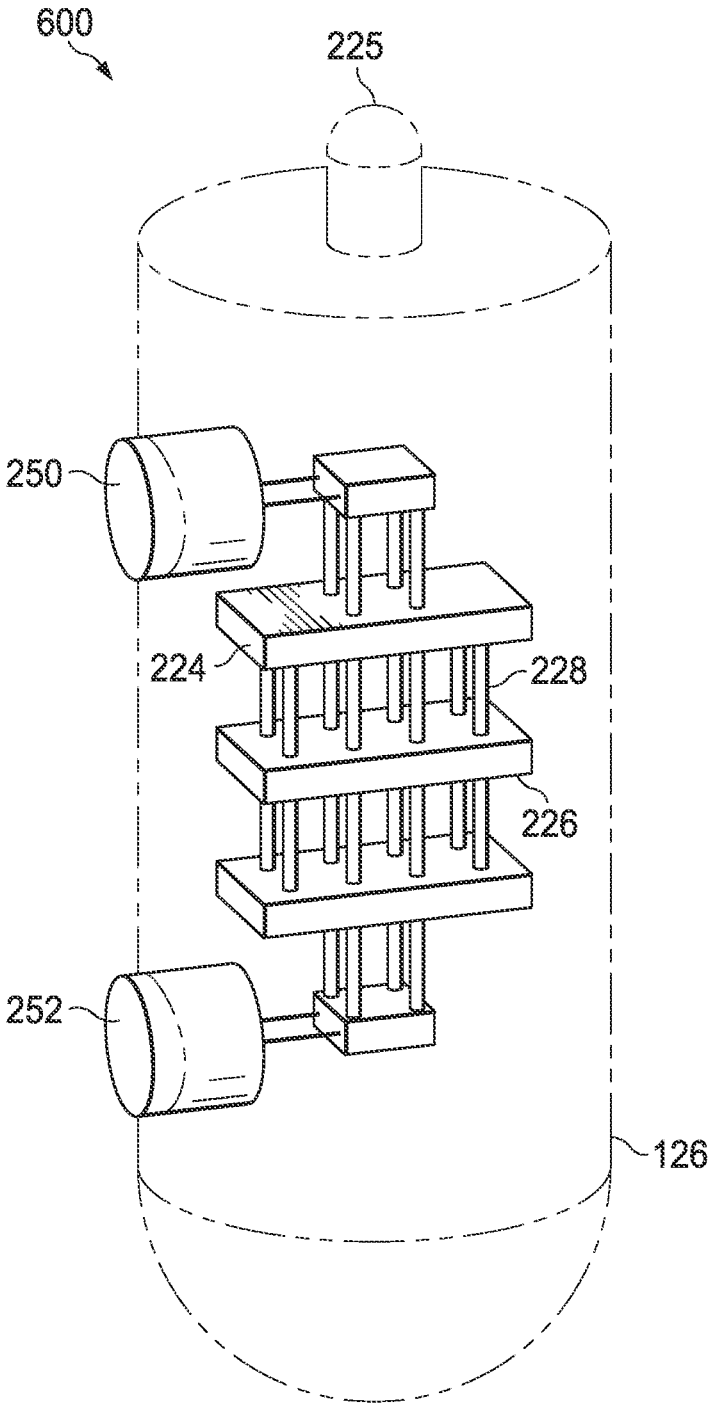

FIGS. 6A-6B are schematic views of a downhole autonomous jet cutting tool 122 with a sensor module 600 incorporating an ultrasonic sensor. The sensor module 600 is substantially similar to the sensor module 500 but incorporates top and bottom ultrasonic sensors 250, 252 in place of the acoustic sensors. The sensor module 600 can in some embodiments include rotating transducers with a motor enabling them to rotate around the sensor module 600 as the downhole autonomous jet cutting tool 122 is traveling downhole. The microelectronics 224, 226, and 228 perform signal processing and analysis to determine the stuck point 200 by comparing the sensor outputs from the top sensor 250 and the bottom sensor 252. This sensor module 600 uses an ultrasonic pulse echo technique. The transceiver 238 transmits an acoustic pulse at a frequency and listens for the "echo" from this pulse. In some embodiments, the frequency is between 200 and 700 kHz. The pulse propagates back and forth and creates additional pulses at the receiver 240 (for example, an "echo" train). The sound propagation time is determined by the sound velocity and by the associated elastic constant. The time evolution of the amplitude of the received pulse is defined by the sound attenuation. In an example, a pulse would reflect back from the interface between the drill string 120 and the drilling fluid 112 or at the interface between the casing 118 and the wall of the wellbore 116. Some of the energy is reflected and some is refracted. At a stuck pipe location, the attenuation will be lower and the amplitude of the echo pulse higher. The transceivers can be spaced apart and able to communicate with one another. The spacing can be between three and ten feet. As the autonomous jet cutting tool 122 travels downhole, the transceivers are constantly acquiring and comparing data. As a result of the spacing, one transceiver reaches the stuck point 200 before the other. This acoustic change between the transceivers can be used to determine the depth of the stuck point 200. In an example, if one transceiver is not exactly at the stuck point location the change in acoustic contrast may still be apparent, thus enabling determination of the stuck point or at least an axial range within which is the stuck point.

Figure 7A:
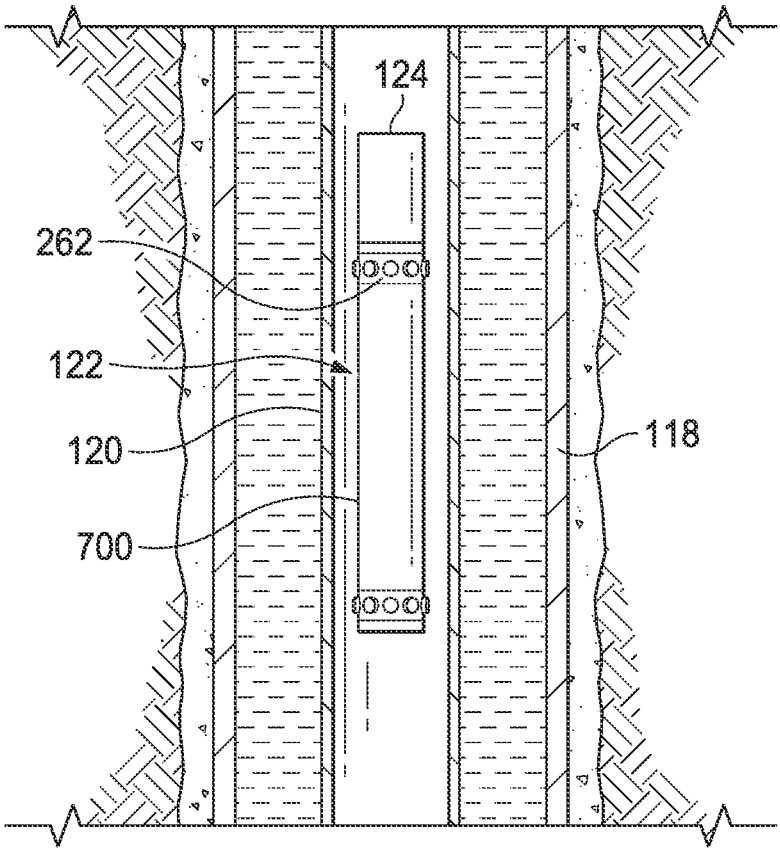
FIGS. 7A-7B are schematic views of a downhole autonomous jet cutting tool with a sensor module configuration incorporating a transceiver array.
Figure 7B:
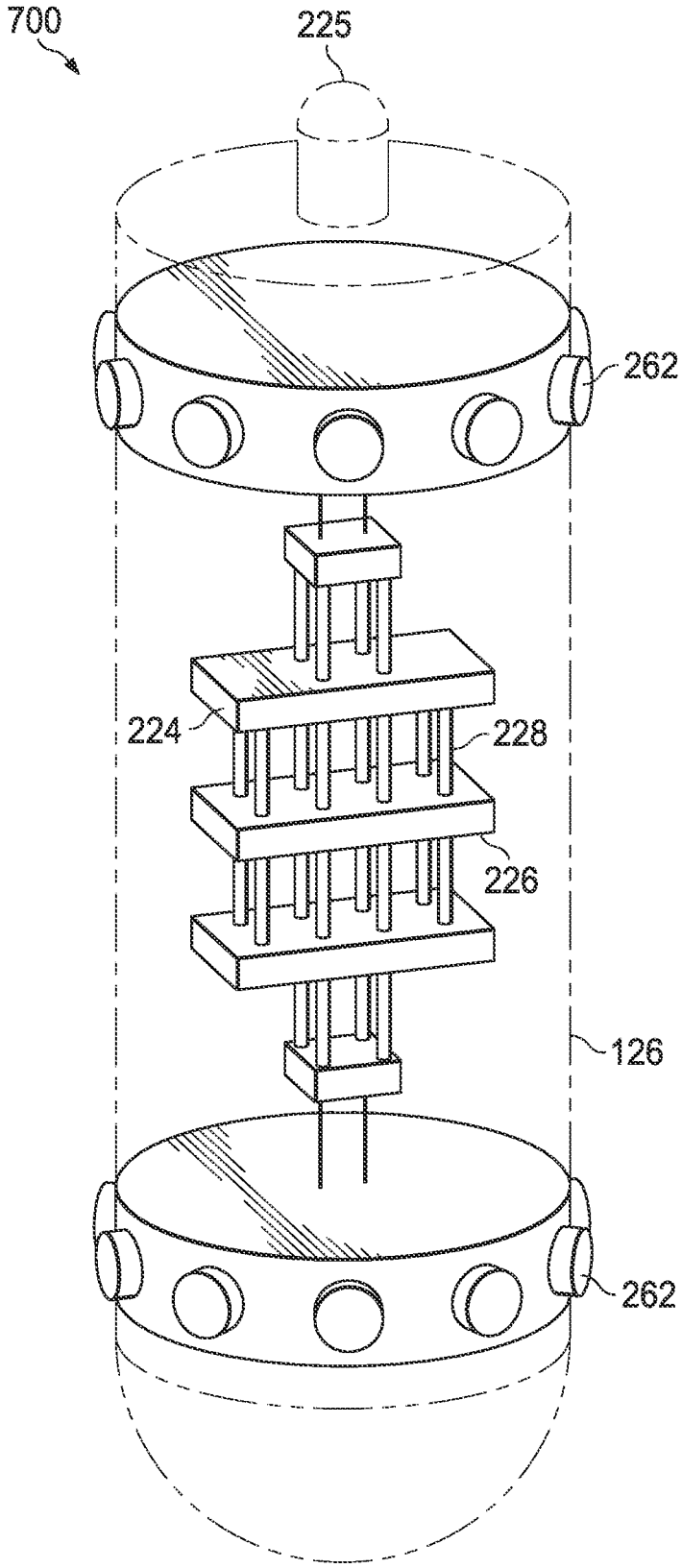

FIGS. 7A-7B are schematic views of a downhole autonomous jet cutting tool 122 with a sensor module 700 incorporating transceiver arrays 262. The sensor module 700 is substantially similar to the sensor module 500 but incorporates transmitters and receivers configured as transceiver arrays 262. This configuration enables full coverage of the drill string 120. A similar methodology of having two transducer arrays spaced apart can be utilized to determine the stuck point depth (as shown in FIG. 5).

Figure 8B:
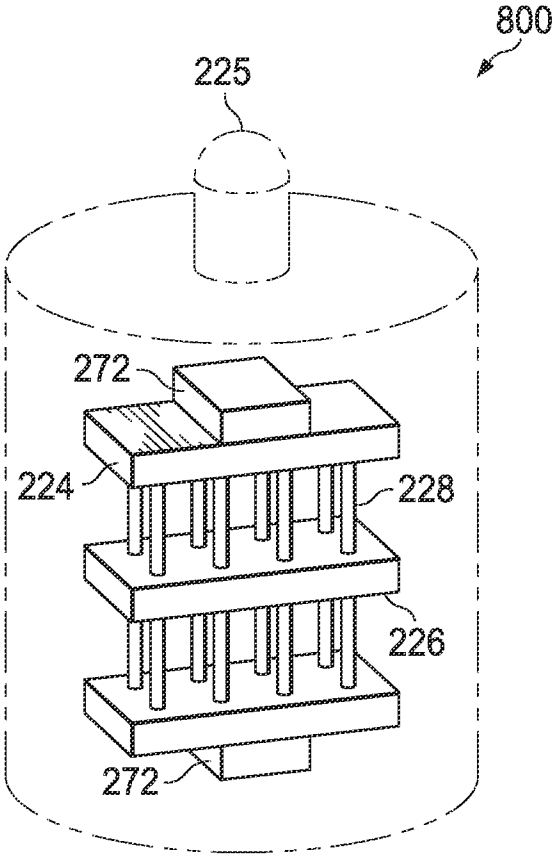
FIGS. 8A-8B are schematic views of a downhole autonomous jet cutting tool with a sensor module configuration incorporating electromagnetic wave-based sensors.
Figure 8A:
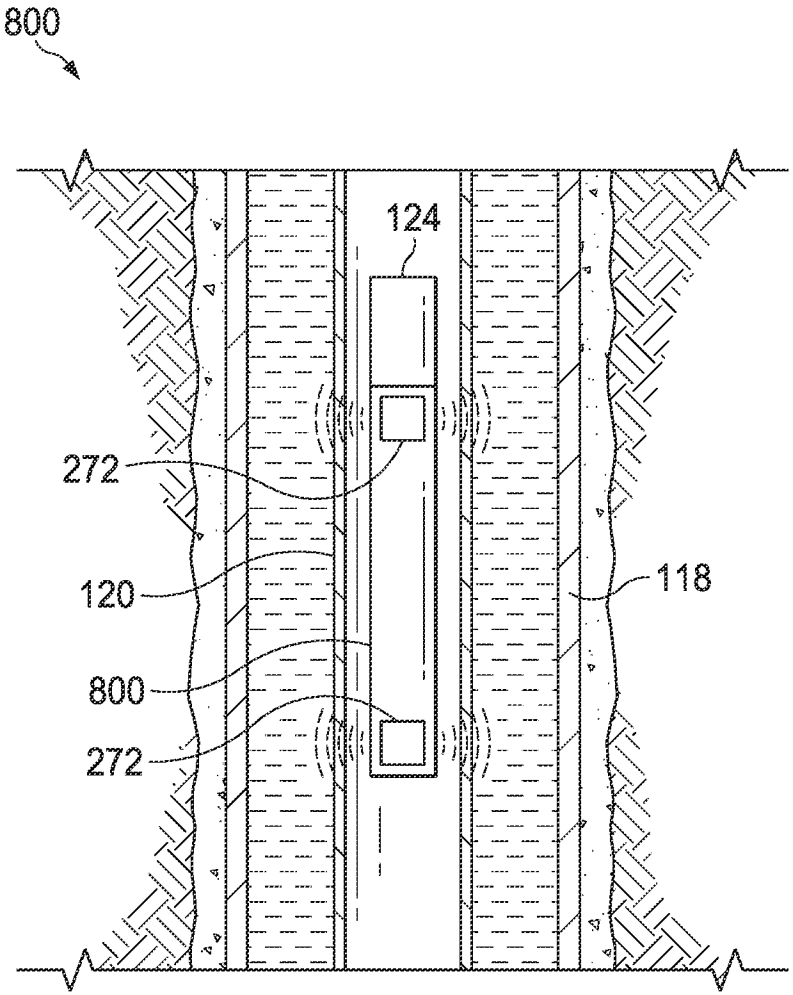

FIGS. 8A-8B are schematic views of a downhole autonomous jet cutting tool 122 with a sensor module 800 incorporating electromagnetic wave-based sensors 272. The sensor module 800 is substantially similar to the sensor module 500 but incorporates transmitters and receivers configured as electromagnetic wave-based sensors 272. The sensor module 800 can include two electromagnets spaced apart and able to communicate with each other downhole. As the downhole autonomous jet cutting tool 122 travels downhole, the electromagnets generate a magnetic field and an increased tension or torque is applied to the drill string 120. In an example, a steel drill pipe is demagnetized due to the deformation caused by tension or torque applied to the drill string 120. The section of the drill string 120 above the stuck point 200 is also demagnetized but the section below the stuck point 200 retains its ferromagnetic properties. In this case, the two electromagnets record a low or no magnetic flux density at the section of the drill pipe above the stuck point 200. In an example, when one of the electromagnets reaches the stuck point 200, or is below the stuck point 200, a clear magnetic contrast is obtained between the magnetic flux density values above and below the stuck point 200. The magnetic sensors 272 can detect magnetic fields from electromagnets. The magnetic sensors can be thin film sensors (for example, giant magnetoresistance sensors (GMRs), tunneling magnetoresistance sensors (TMRs), and Hall sensors). In some embodiments, the MEMS technology, the magnetic sensor, and the electromagnet can be integrated into a single device. In another example, a magnetic sensor can be fabricated as a MEMS device that operates with less power than larger sensors such as fluxgate magnetometers. In some examples, both the magnetic and the acoustic type sensors maybe integrated into one sensor module.

Figure 9:
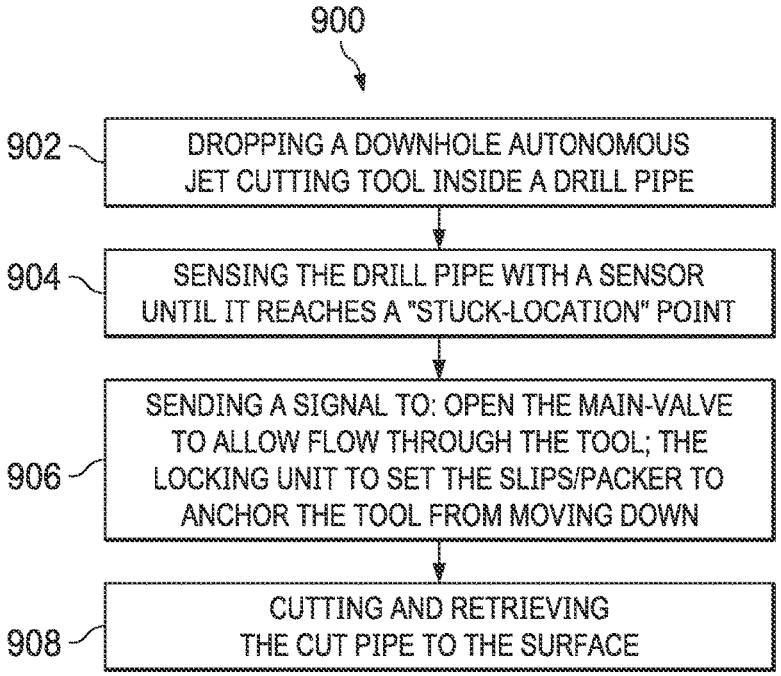
FIG. 9 is a flowchart showing a method for cutting a pipe in a wellbore.

FIG. 9 is a flowchart of a method 900 for cutting a pipe in a wellbore in accordance with some embodiments of the present disclosure. During drilling operations, a pipe is stuck within the wellbore. A downhole autonomous jet cutting tool is dropped inside a drill pipe (902). The downhole autonomous jet cutting tool senses properties of the drill pipe until the sensor module detects the change in sensor output such as a change in attenuation acoustic wave (904). This change is correlated to detecting and identifying the stuck pipe location and the depth of the "stuck" location. The real-time data from the sensor module is transmitted to the control unit within the downhole autonomous jet cutting tool. The control unit processes the received data using the data processing system to determine if the tool has reached the stuck point. The control unit then sends a signal (906) to open the main valve to allow flow through the tool and actuate the grip elements to anchor the tool in position. Once the downhole autonomous jet cutting tool is anchored in place, flow through the tool powers the jet cutting nozzle assembly to start cutting the stuck pipe (908). Once the cutting is completed, the cut pipe is fished and retrieved to the surface.

FIG. 10 is a block diagram of an example computer system 1024 used to provide computational functionalities associated with described algorithms, methods, functions, processes, flows, and procedures described in the present disclosure, according to some implementations of the present disclosure. The illustrated computer 1020 is intended to encompass any computing device such as a server, a desktop computer, a laptop/notebook computer, a wireless data port, a smartphone, a personal data assistant (PDA), a tablet computing device, or one or more processors within these devices, including physical instances, virtual instances, or both. The computer 1020 can include input devices such as keypads, keyboards, and touch screens that can accept user information. Also, the computer 1020 can include output devices that can convey information associated with the operation of the computer 1020 The information can include digital data, visual data, audio information, or a combination of information. The information can be presented in a graphical user interface (UI) (or GUI). In some embodiments, the control unit of the downhole autonomous jet cutting cool of the present disclosure (such as control unit 138 of FIGS. 2A and 2B) can be, can be a component of, or can be in wired or wireless communication with computer 1020 or its components or other components. Computer 1020 can in some embodiments be located at a surface location (in whole or in part) and in some embodiments can be located at a subsurface or downhole location (in whole or in part).

The computer 1020 can serve in a role as a client, a network component, a server, a database, a persistency, or components of a computer system for performing the subject matter described in the present disclosure. The illustrated computer 1020 is communicably coupled with a network 1002. In some implementations, one or more components of the computer 1020 can be configured to operate within different environments, including cloud-computing-based environments, local environments, global environments, and combinations of environments.

At a high level, the computer 1020 is an electronic computing device operable to receive, transmit, process, store, and manage data and information associated with the described subject matter. According to some implementations, the computer 1020 can also include, or be communicably coupled with, an application server, an email server, a web server, a caching server, a streaming data server, or a combination of servers.

The computer 1020 can receive requests over network 1002 from a client application (for example, executing on another computer 1020). The computer 1020 can respond to the received requests by processing the received requests using software applications. Requests can also be sent to the computer 1020 from internal users (for example, from a command console), external (or third) parties, automated applications, entities, individuals, systems, and computers. Each of the components of the computer 1020 can communicate using a system bus 1010. In some implementations, any or all of the components of the computer 1020, including hardware or software components, can interface with each other or the interface 1004 (or a combination of both), over the system bus 1010. Interfaces can use an application programming interface (API) 1014, a service layer 1016, or a combination of the API 1014 and service layer 1016. The API 1014 can include specifications for routines, data structures, and object classes. The API 1014 can be either computer-language independent or dependent. The API 1014 can refer to a complete interface, a single function, or a set of APIs.

The service layer 1016 can provide software services to the computer 1020 and other components (whether illustrated or not) that are communicably coupled to the computer 1020. The functionality of the computer 1020 can be accessible for all service consumers using this service layer. Software services, such as those provided by the service layer 1016, can provide reusable, defined functionalities through a defined interface. For example, the interface can be software written in JAVA, C++, or a language providing data in extensible markup language (XML) format. While illustrated as an integrated component of the computer 1020, in alternative implementations, the API 1014 or the service layer 1016 can be stand-alone components in relation to other components of the computer 1020 and other components communicably coupled to the computer 1020. Moreover, any or all parts of the API 1014 or the service layer 1016 can be implemented as child or sub-modules of another software module, enterprise application, or hardware module without departing from the scope of the present disclosure.

The computer 1020 includes an interface 1004. Although illustrated as a single interface 1004 in FIG. 10, two or more interfaces 1004 can be used according to particular needs, desires, or particular implementations of the computer 1020 and the described functionality. The interface 1004 can be used by the computer 1020 for communicating with other systems that are connected to the network 1002 (whether illustrated or not) in a distributed environment. Generally, the interface 1004 can include, or be implemented using, logic encoded in software or hardware (or a combination of software and hardware) operable to communicate with the network 1002. More specifically, the interface 1004 can include software supporting one or more communication protocols associated with communications. As such, the network 1002 or the interface's hardware can be operable to communicate physical signals within and outside of the illustrated computer 1020.

The computer 1020 includes a processor 1006. Although illustrated as a single processor 1006 in FIG. 10, two or more processors 1006 can be used according to particular needs, desires, or particular implementations of the computer 1020 and the described functionality. Generally, the processor 1006 can execute instructions and can manipulate data to perform the operations of the computer 1020, including operations using algorithms, methods, functions, processes, flows, and procedures as described in the present disclosure.

The computer 1020 also includes a database 1022 that can hold data for the computer 1020 and other components connected to the network 1002 (whether illustrated or not). For example, database 1022 can be an in-memory, conventional, or a database storing data consistent with the present disclosure. In some implementations, database 1022 can be a combination of two or more different database types (for example, hybrid in-memory and conventional databases) according to particular needs, desires, or particular implementations of the computer 1020 and the described functionality. Although illustrated as a single database 1022 in FIG. 10, two or more databases (of the same, different, or combination of types) can be used according to particular needs, desires, or particular implementations of the computer 1020 and the described functionality. While database 1022 is illustrated as an internal component of the computer 1020, in alternative implementations, database 1022 can be external to the computer 1020.

The computer 1020 also includes a memory 1008 that can hold data for the computer 1020 or a combination of components connected to the network 1002 (whether illustrated or not). Memory 1008 can store any data consistent with the present disclosure. In some implementations, memory 1008 can be a combination of two or more different types of memory (for example, a combination of semiconductor and magnetic storage) according to particular needs, desires, or particular implementations of the computer 1020 and the described functionality. Although illustrated as a single memory 1008 in FIG. 10, two or more memories 1008 (of the same, different, or combination of types) can be used according to particular needs, desires, or particular implementations of the computer 1020 and the described functionality. While memory 1008 is illustrated as an internal component of the computer 1020, in alternative implementations, memory 1008 can be external to the computer 1020.

The application 1012 can be an algorithmic software engine providing functionality according to particular needs, desires, or particular implementations of the computer 1020 and the described functionality. For example, application 1012 can serve as one or more components, modules, or applications. Further, although illustrated as a single application 1012, the application 1012 can be implemented as multiple applications 1012 on the computer 1020. In addition, although illustrated as internal to the computer 1020, in alternative implementations, the application 1012 can be external to the computer 1020.

The computer 1020 can also include a power supply 1018. The power supply 1018 can include a rechargeable or non-rechargeable battery that can be configured to be either user- or non-user-replaceable. In some implementations, the power supply 1018 can include power-conversion and management circuits, including recharging, standby, and power management functionalities. In some implementations, the power-supply 1018 can include a power plug to allow the computer 1020 to be plugged into a wall socket or a power source to, for example, power the computer 1020 or recharge a rechargeable battery.

There can be any number of computers 1020 associated with, or external to, a computer system containing computer 1020, with each computer 1020 communicating over network 1002. Further, the terms "client," "user," and other appropriate terminology can be used interchangeably, as appropriate, without departing from the scope of the present disclosure. Moreover, the present disclosure contemplates that many users can use one computer 1020 and one user can use multiple computers 1020.

Implementations of the subject matter and the functional operations described in this specification can be implemented in digital electronic circuitry, intangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially-generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

A number of embodiments of these systems and methods have been described. Nevertheless, it will be understood that various modifications may be made without departing from the spirit and scope of this disclosure. Accordingly, other embodiments are within the scope of the following claims.

What is claimed:

1. A downhole autonomous jet cutting tool configured to cut a pipe in a wellbore, the downhole autonomous jet cutting tool comprising:

a main body having a generally cylindrical configuration such that the main body limits a downhole flow of fluids past the autonomous jet cutting tool between the autonomous jet cutting tool and the pipe when the tool is deployed in the pipe, the main body comprising:

a locking unit actuable to engage the tool to an inner surface of the pipe; and a hydraulic motor comprising a rotor and a stator; and a jet cutting nozzle assembly rotatable by the rotor and operable to emit a stream of fluid to cut the pipe;

a sensor module operable to detect interactions between the pipe and walls of the wellbore, the sensor module comprising at least one of:

an acoustic transmitter and an acoustic receiver, the acoustic transmitter oriented to send an acoustic signal radially outward relative to an axis of the tool: or an electromagnetic transmitter and an electromagnetic receiver, the electromagnetic transmitter oriented to generate a magnetic field radially outward relative to an axis of the tool; and a control unit in electronic communication with the sensor module and the locking unit, the control unit configured to:

identify, based on output of the sensor module, a location where interaction between the pipe and the walls of the wellbore limits downhole movement of the pipe based on at least one of:

a change in attenuation of the acoustic signal: or a difference between electromagnetic sensor outputs;

actuate the locking unit to engage the tool in the inner surface of the pipe; and initiate the stream of fluid from the jet cutting nozzle assembly.

2. The downhole autonomous jet cutting tool of claim 1, wherein the locking unit comprises a packer.

3. The downhole autonomous jet cutting tool of claim 2, wherein the locking unit comprises slips.

4. The downhole autonomous jet cutting tool of claim 1, wherein the sensor module comprises an acoustic transmitter oriented to send an acoustic signal radially outward relative to an axis of the tool.

5. The downhole autonomous jet cutting tool of claim 4, wherein the acoustic signal has a frequency of 20-30 kHz.

6. The downhole autonomous jet cutting tool of claim 1, wherein the sensor module comprises an electromagnetic transmitter oriented to generate magnetic field radially outward relative to an axis of the tool.

7. The downhole autonomous jet cutting tool of claim 1, wherein the sensor module comprises an ultrasonic sensor.

8. The downhole autonomous jet cutting tool of claim 1, wherein the hydraulic motor comprises a rotor embedded inside a stator and the jet cutting nozzle assembly is rotationally fixed to the rotor.

9. The downhole autonomous jet cutting tool of claim 8, wherein the body further comprises rubber baffles extending radially outward.

10. The downhole autonomous jet cutting tool of claim 1, wherein initiating the stream of fluid from the jet cutting nozzle assembly comprises opening a valve in the main body to permit drilling fluid to enter the main body and exit the jet cutting nozzle assembly.

11. The downhole autonomous jet cutting tool of claim 10, wherein the rotor rotates in response to the drilling fluid flowing through the main body.

12. A method for cutting a pipe in a wellbore, the method comprising:

dropping a downhole autonomous jet cutting tool in a pipe, the downhole autonomous jet cutting tool controlled by a flow rate and configured to identify a location where interaction between the pipe and walls of the wellbore limits a downhole movement of the pipe;

sensing the pipe with a sensor module until it reaches the location where interaction between the pipe and the walls of the wellbore limits a downhole movement of the pipe, the sensor module comprising at least one of:

an acoustic transmitter and an acoustic receiver, the acoustic transmitter oriented to send an acoustic signal radially outward relative to an axis of the tool; or an electromagnetic transmitter and an electromagnetic receiver, the electromagnetic transmitter oriented to generate a magnetic field radially outward relative to an axis of the tool;

receiving a signal from the sensor module with an identified location based on at least one of:

a change in attenuation of the acoustic signal; or a difference between electromagnetic sensor outputs;

sending a signal to the tool to:

actuate a locking unit to lock the downhole autonomous jet cutting tool in a position proximate to the location where interaction between the pipe and the walls of the wellbore limits a downhole movement of the pipe; and initiate a flow of fluid from a cutting nozzle of the tool to cut the pipe.

* * * * *